US009444129B2

(12) United States Patent
Aizawa

(10) Patent No.: US 9,444,129 B2
(45) Date of Patent: Sep. 13, 2016

(54) MULTI-BAND COMPATIBLE MULTI-ANTENNA DEVICE AND COMMUNICATION EQUIPMENT

(75) Inventor: Daisuke Aizawa, Daito (JP)

(73) Assignee: FUNAI ELECTRIC CO., LTD., Osaka (JP)

( * ) Notice: Subject to any disclaimer, the term of this patent is extended or adjusted under 35 U.S.C. 154(b) by 419 days.

(21) Appl. No.: 13/468,217

(22) Filed: May 10, 2012

(65) Prior Publication Data

US 2012/0287012 A1 Nov. 15, 2012

(30) Foreign Application Priority Data

May 13, 2011 (JP) ..... 2011-108676
May 13, 2011 (JP) ..... 2011-108683

(51) Int. Cl.

| | |
|---|---|
| ***H01Q 1/24*** | (2006.01) |
| ***H01Q 5/392*** | (2015.01) |
| ***H01Q 5/371*** | (2015.01) |
| ***H01Q 1/52*** | (2006.01) |
| ***H01Q 21/28*** | (2006.01) |

(52) U.S. Cl.
CPC ..... *H01Q 1/243* (2013.01); *H01Q 1/521* (2013.01); *H01Q 5/371* (2015.01); *H01Q 5/392* (2015.01); *H01Q 21/28* (2013.01)

(58) Field of Classification Search
CPC ..... H01Q 5/0062; H01Q 5/0065; H01Q 5/0068; H01Q 19/005; H01Q 1/243; H01Q 5/371; H01Q 5/392
USPC ..... 343/833, 834, 835, 702
See application file for complete search history.

(56) References Cited

U.S. PATENT DOCUMENTS

2006/0038736 A1* 2/2006 Hui ..... H01Q 1/521 343/835
2006/0279465 A1 12/2006 Moon et al.
(Continued)

FOREIGN PATENT DOCUMENTS

JP 11-317612 A 11/1999
JP 2001-144524 A 5/2001
(Continued)

OTHER PUBLICATIONS

Official Communication issued in corresponding Japanese Patent Application No. 2011-108676, mailed on Sep. 16, 2014.
Official Communication issued in corresponding Japanese Patent Application No. 2011-108683, mailed on Sep. 16, 2014.

*Primary Examiner* — Robert Karacsony
(74) *Attorney, Agent, or Firm* — Keating & Bennett, LLP

(57) ABSTRACT

A multi-band compatible multi-antenna device which is miniaturized by reducing a distance between antenna elements includes a first antenna element corresponding to a 1.5 GHz band and a 2.0 GHz band, a second antenna element corresponding to the 1.5 GHz band and the 2.0 GHz band, a first passive element which is arranged between the first antenna element and the second antenna element and which resonates at a frequency corresponding to the 1.5 GHz band, and a second passive element which is arranged between the first antenna element and the second antenna element separately from the first passive element and which resonates at a frequency corresponding to the 2.0 GHz band.

14 Claims, 29 Drawing Sheets

(56) References Cited

U.S. PATENT DOCUMENTS

| | | | | |
|---|---|---|---|---|
| 2007/0069960 | A1 | 3/2007 | Moon et al. | |
| 2008/0018539 | A1 | 1/2008 | Jung et al. | |
| 2009/0091507 | A1* | 4/2009 | Chung et al. | 343/841 |
| 2010/0053022 | A1* | 3/2010 | Mak | H01Q 1/2283 343/893 |
| 2013/0002510 | A1* | 1/2013 | Azulay | H01Q 1/243 343/860 |

FOREIGN PATENT DOCUMENTS

| | | | |
|---|---|---|---|
| JP | 2006-352871 | A | 12/2006 |
| JP | 2008-29001 | A | 2/2008 |

* cited by examiner

MULTI-BAND COMPATIBLE MULTI-ANTENNA DEVICE AND COMMUNICATION EQUIPMENT

BACKGROUND OF THE INVENTION

1. Field of the Invention

The present invention relates to a multi-band compatible multi-antenna device and communication equipment, and more specifically to a multi-band compatible multi-antenna device including a plurality of antenna elements and communication equipment including such a multi-band compatible multi-antenna device.

2. Description of the Related Art

Multi-band compatible multi-antenna devices including a plurality of antenna elements have been conventionally known (see Japanese Patent Application Laid-Open Publication No. 2008-29001, for example).

The aforementioned Japanese Patent Application Laid-Open Publication No. 2008-29001 discloses a multi-band compatible MIMO antenna (multi-antenna device) including two antenna elements. Each of the antenna elements of this MIMO antenna includes a first radiating plate, a second radiating plate, and a PIN diode that can electrically link the first radiating plate and the second radiating plate to each other, and the PIN diode is configured so as to be able to switch by switching control to either a state in which the first radiating plate and the second radiating plate are linked to each other or a state in which the first radiating plate and the second radiating plate are separated from each other. Thus, as a result of the use of switching control to link or separate the first radiating plate and the second radiating plate, the full length of each antenna element is switched, thereby the MIMO antenna of Japanese Patent Application Laid-Open Publication No. 2008-29001 is compatible with different frequency bands.

However, with the multi-band compatible MIMO antenna of Japanese Patent Application Laid-Open Publication No. 2008-29001, while different frequency bands can be handled by switching the full length of each antenna element using switching control, there is a problem in that the MIMO antenna cannot be miniaturized because the distance between the antenna elements needs to be large so as to reduce an amount of the interconnection between the antenna elements.

SUMMARY OF THE INVENTION

Preferred embodiments of the present invention provide a multi-band compatible multi-antenna device that is miniaturized by reducing a distance between antenna elements, and also provide communication equipment including such a multi-band compatible multi-antenna device.

In a multi-antenna device according to a preferred embodiment of the present invention, a first passive element which resonates at a frequency corresponding to a first frequency band is provided between a first antenna element and a second antenna element, and a second passive element which resonates at a frequency corresponding to a second frequency band is provided between the first antenna element and the second antenna element separately from the first passive element. By using this arrangement, an amount of interconnection between the antenna elements can be reduced and, as a result, miniaturization is possible by reducing the distance between the antenna elements. Note that the effect of being able to reduce the amount of interconnection between the antenna elements using the unique configuration of a preferred embodiment of the present invention as described in the preceding paragraph has been confirmed through simulation which will be described later.

Specifically, the multi-band compatible multi-antenna device according to a first preferred embodiment of the present invention includes a first antenna element corresponding to a first frequency band and a second frequency band, a second antenna element corresponding to the first frequency band and the second frequency band, a first passive element which is disposed between the first antenna element and the second antenna element and which resonates at the frequency corresponding to the first frequency band, and a second passive element which is disposed between the first antenna element and the second antenna element, separately from the first passive element, and which resonates at the frequency corresponding to the second frequency band.

In the multi-band compatible multi-antenna device according to the first preferred embodiment of the present invention, as a result of a first passive element which resonates at the frequency corresponding to the first frequency band being provided between the first antenna element and the second antenna element, and as a result of a second passive element which resonates at the frequency corresponding to the second frequency band being provided between the first antenna element and the second antenna element separately from the first passive element, it is possible to reduce the amount of interconnection between the antenna elements. Furthermore, because the amount of interconnection between the first antenna element and the second antenna element can be reduced, the distance between the antenna elements can be correspondingly reduced and, as a result, it is possible to miniaturize the multi-band compatible multi-antenna device. Accordingly, this multi-band compatible multi-antenna device can be miniaturized by reducing the distance between the antenna elements.

In the multi-band compatible multi-antenna device according to the first preferred embodiment of the present invention, the first passive element and the second passive element are both disposed between the first antenna element and the second antenna element in positions in which electromagnetic coupling to both the first antenna element and the second antenna element is possible. Note that in the present application, electromagnetic coupling is a broad concept that includes both capacitive coupling and magnetic coupling. By adopting such a configuration, both the first passive element and the second passive element are electromagnetically coupled to the first antenna element and the second antenna element, thus making it possible to reduce the amount of interconnection between the antenna elements.

In the multi-band compatible multi-antenna device according to the first preferred embodiment, it is preferable that at least one of the first passive element and the second passive element be ungrounded. If such a configuration is adopted, it is not necessary to ground at least one of the first passive element and the second passive element to a specified ground surface, and accordingly, it is possible to inhibit a decrease in the degree of freedom in wiring pattern design.

In this case, it is preferable that each of the first passive element and the second passive element have an electrical length of ½ of the wavelength of the electric wave or substantially ½ of the wavelength of the electric wave that is output in the corresponding frequency band by the first antenna element and the second antenna element. Such a configuration makes it possible to easily have each of the passive elements resonate at the corresponding frequency.

In the multi-band compatible multi-antenna device according to the first preferred embodiment of the present invention, it is preferable that the first antenna element and the second antenna element each include a first frequency band corresponding unit corresponding to the first frequency band and a second frequency band corresponding unit corresponding to the second frequency band, and that at least the second passive element be disposed between the second frequency band corresponding units of the first antenna element and second antenna element in an area corresponding to the second frequency band corresponding units. By adopting such a configuration, the second passive element and the second frequency band corresponding units can be disposed more closely, so it is possible to easily couple the second passive element and the second frequency band corresponding units.

In this case, it is preferable that the respective first frequency band corresponding units of the first antenna element and second antenna element each include a power supply connection portion connected to a feeding point to which high-frequency power is supplied and a main unit portion which is linked to the power supply connection portion and which is disposed on the side of the second frequency band corresponding unit opposite from the side on which the feeding point is disposed, that the second passive element be disposed between the second frequency band corresponding units of the first antenna element and second antenna element in an area corresponding to the second frequency band corresponding units, and that the first passive element be disposed between the main unit portions of the first frequency band corresponding units of the first antenna element and second antenna element in an area corresponding to the main unit portions. With such a configuration, it is possible to easily couple the second passive element and the second frequency band corresponding units by disposing the second passive element and the second frequency band corresponding units more closely and it is also possible to easily couple the first passive element and the first frequency band corresponding units by disposing the first passive element and the main unit portions of the first frequency band corresponding units more closely.

In the multi-band compatible multi-antenna device according to the first preferred embodiment of the present invention, it is preferable that the first antenna element and the second antenna element both be shaped so as to be bent or curved at a plurality of positions, and that the first passive element and the second passive element both be shaped so as to be bent or curved at a plurality of positions between the first antenna element and the second antenna element. If such a configuration is adopted, the lengths respectively required for the antenna elements and passive elements can be easily ensured by the bent or curved shapes of the antenna elements and passive elements, so it is possible to prevent the expansion of the installation space for the antenna elements and passive elements and, as a result, the multi-antenna device can be miniaturized even further.

In the multi-band compatible multi-antenna device according to the first preferred embodiment of the present invention, it is preferable that the first antenna element, the second antenna element, the first passive element, and the second passive element all be disposed within the same plane. By adopting such a configuration, all of the antenna elements and the passive elements are disposed within a common plane, so the configuration of the multi-antenna device can be simplified.

In the multi-band compatible multi-antenna device according to the first preferred embodiment of the present invention, it is preferable that the first passive element be disposed within a first plane, and that the second passive element be disposed within a second plane which is different from the first plane. By adopting such a configuration, the first passive element and the second passive element can be disposed so as to be distributed on different surfaces from each other, so it is possible to prevent the space required to install the first passive element and the second passive element from becoming too large within a single plane. Moreover, because the first passive element and the second passive element can be disposed on different planes from each other, it is possible to increase the degree of freedom in the arrangement of the equipment internal configuration.

In the multi-band compatible multi-antenna device according to the first preferred embodiment of the present invention, it is preferable that the first antenna element and the second antenna element be provided in a substantially line symmetrical shape with respect to each other and to a reference straight line which is perpendicular or substantially perpendicular to the straight line connecting the respective feeding points of the first antenna element and second antenna element having high-frequency power supplied thereto and which passes through the midpoint between the feeding points, and that the first passive element and the second passive element both be provided in a substantially line symmetrical shape with respect to the reference straight line. If such a configuration is adopted, the antenna elements and the passive elements are each disposed with good balance, so it is possible to suppress gain variations while reducing the amount of interconnection between the antenna elements.

In the multi-band compatible multi-antenna device according to the first preferred embodiment of the present invention, it is preferable that the first antenna element and the second antenna element both correspond to a third frequency band in addition to the first frequency band and the second frequency band, and that this multi-antenna device further include a third passive element which is disposed between the first antenna element and the second antenna element separately from the first passive element and the second passive element and which resonates at the frequency corresponding to the third frequency band. By adopting such a configuration, it is possible to obtain a multi-antenna device compatible with a triple band which can be miniaturized by reducing the distance between the antenna elements.

In the multi-band compatible multi-antenna device according to the first preferred embodiment of the present invention, it is preferable that this multi-antenna device further include matching circuits which are respectively disposed on the side of the first antenna element and on the side of the second antenna element, between the antenna elements and the feeding points having high-frequency power supplied thereto and which are used to achieve impedance matching at the frequency corresponding to the first frequency band and the frequency corresponding to the second frequency band of the high-frequency power. If such a configuration is adopted, the matching circuits make it possible to achieve impedance matching at the frequency corresponding to the first frequency band and the frequency corresponding to the second frequency band, so that it is possible to reduce transmission loss of the energy transmitted via the antenna elements while miniaturizing the multi-antenna device.

In the multi-band compatible multi-antenna device according to the first preferred embodiment of the present invention, it is preferable that the first antenna element and the second antenna element each include a monopole antenna. By adopting such a configuration, it is possible to miniaturize the multi-band compatible multi-antenna device using a monopole antenna which is smaller than a dipole antenna.

The multi-band compatible communication equipment according to a second preferred embodiment of the present invention is communication equipment including a multi-band compatible multi-antenna device, wherein the multi-band compatible multi-antenna device includes a first antenna element corresponding to a first frequency band and a second frequency band, a second antenna element corresponding to the first frequency band and the second frequency band, a first passive element which is disposed between the first antenna element and the second antenna element and which resonates at the frequency corresponding to the first frequency band, and a second passive element which is disposed between the first antenna element and the second antenna element separately from the first passive element and which resonates at the frequency corresponding to the second frequency band.

In the multi-band compatible communication equipment according to the second preferred embodiment of the present invention, as a result of a first passive element which resonates at the frequency corresponding to the first frequency band being provided between the first antenna element and the second antenna element, and as a result of a second passive element which resonates at the frequency corresponding to the second frequency band being provided between the first antenna element and the second antenna element separately from the first passive element as described above, it is possible to reduce the amount of interconnection between the antenna elements. In addition, because the amount of interconnection between the first antenna element and the second antenna element can be reduced, the distance between the antenna elements can be correspondingly reduced and, as a result, it is possible to miniaturize the multi-band compatible multi-antenna device.

Additional preferred embodiments of the present invention include a single passive element which resonates at both the frequency corresponding to a first frequency band and the frequency corresponding to a second frequency band and is provided between the first antenna element and the second antenna element. As a result, the amount of interconnection between the antenna elements can be reduced and, therefore, miniaturization is possible by reducing the distance between the antenna elements. Note that the effect of being able to reduce the amount of interconnection between the antenna elements through the aforementioned additional preferred embodiments has been confirmed through simulation as will be described below.

A multi-band compatible multi-antenna device according to a third preferred embodiment of the present invention includes a first antenna element corresponding to a first frequency band and a second frequency band, a second antenna element corresponding to the first frequency band and the second frequency band, and a single passive element which is disposed between the first antenna element and the second antenna element and which resonates at both the frequency corresponding to the first frequency band and the frequency corresponding to the second frequency band.

In the multi-band compatible multi-antenna device according to the third preferred embodiment of the present invention, as a result of a single passive element which resonates at both the frequency corresponding to the first frequency band and the frequency corresponding to the second frequency band being provided between the first antenna element and the second antenna element, it is possible to reduce the amount of interconnection between the antenna elements. Furthermore, because the amount of interconnection between the first antenna element and the second antenna element can be reduced, the distance between the antenna elements can be correspondingly reduced and, as a result, it is possible to miniaturize the multi-band compatible multi-antenna device. Accordingly, this multi-band compatible multi-antenna device can be miniaturized by reducing the distance between the antenna elements.

Moreover, by configuring the single passive element so as to resonate at both the frequency corresponding to the first frequency band and the frequency corresponding to the second frequency band, it is possible to prevent the passive element installation space becoming large as compared to a case in which a passive element which resonates at the frequency corresponding to the first frequency band and a passive element which resonates at the frequency corresponding to the second frequency band are providing separately from each other. In addition, by configuring the first antenna element and the second antenna element so as to both correspond to the first frequency band and the second frequency band, the first antenna element and the second antenna element can be used for both the first frequency band and the second frequency band, so the antenna elements can be disposed in a smaller space than is required when providing a different antenna element for each frequency band. Through these measures, it is possible to further miniaturize the multi-band compatible multi-antenna device.

In the multi-band compatible multi-antenna device according to the third preferred embodiment of the present invention, the passive element is disposed between the first antenna element and the second antenna element in a position in which electromagnetic coupling to both the first antenna element and the second antenna element is possible. By adopting such a configuration, the passive element which resonates at both the frequency corresponding to the first frequency band and the frequency corresponding to the second frequency band is electromagnetically coupled to both the first antenna element and the second antenna element, thus making it possible to reduce the amount of interconnection between the antenna elements.

In the multi-band compatible multi-antenna device according to the third preferred embodiment, it is preferable that the passive element be ungrounded. If such a configuration is adopted, it is not necessary to ground the passive element to a specified ground surface, so it is possible to prevent a decrease in the degree of freedom in wiring pattern design.

In this case, it is preferable that the passive element be configured so as to define a first path having an electrical length of ½ of the wavelength $\lambda 1$ of the electric wave or substantially ½ of the wavelength $\lambda 1$ of the electric wave that is output corresponding to the first frequency band by the first antenna element and the second antenna element, and a second path having an electrical length of ½ of the wavelength $\lambda 2$ of the electric wave or substantially ½ of the wavelength $\lambda 2$ of the electric wave that is output corresponding to the second frequency band by the first antenna element and the second antenna element. Such a configuration makes it possible to easily have the single ungrounded passive element resonate at both the frequency corresponding to the first frequency band and the frequency corresponding to the second frequency band.

In the aforementioned configuration in which the first path and the second path are provided in the passive element, it is preferable that the passive element include a main unit portion and a branch portion which branches from the main unit portion, that the first path be configured from the main unit portion, and that the second path be configured from a portion of the main unit portion and the branch portion. By adopting such a configuration, the main unit portion of the passive element can be used for both the first path and the second path, as compared to a case in which the first path and the second path are defined respectively from separate portions, it is possible to miniaturize the passive element and, as a result, further miniaturization of the multi-antenna device becomes possible.

In the aforementioned configuration in which the passive element includes the main unit portion and the branch portion, it is preferable that the branch portion branch from a position at ½ of the full length of the main unit portion or substantially ½ of the full length of the main unit portion, and that the passive element be configured so as to define the first path which is configured from the main unit portion and which has an electrical length of ½ of the wavelength λ1 or substantially ½ of the wavelength λ1, the second path which is configured from the branch portion and a portion of the main unit portion on the side of the first antenna element and which has an electrical length of ½ of the wavelength λ2 or substantially ½ of the wavelength λ2, and a third path which is configured from the branch portion and a portion of the main unit portion on the side of the second antenna element and which has an electrical length of ½ of the wavelength λ2 or substantially ½ of the wavelength λ2 that is substantially the same as the second path. By adopting such a configuration, it is possible to easily have the passive element resonate at the frequency corresponding to the first frequency band using the first path and to have the passive element effectively resonate with respect to the electric wave that is output from the first antenna element and the second antenna element respectively using the second path on the side of the first antenna element and the third path on the side of the second antenna element.

In the aforementioned configuration in which the branch portion branches from a position at ½ of the full length of the main unit portion or substantially ½ of the full length of the main unit portion, it is preferable that the first antenna element and the second antenna element be provided in a substantially line symmetrical shape with respect to each other and to a reference straight line which is perpendicular or substantially perpendicular to the straight line connecting the respective feeding points of the first antenna element and second antenna element having high-frequency power supplied thereto and which passes through the midpoint between the feeding points, and that the main unit portion of the passive element be provided in a substantially line symmetrical shape with respect to the reference straight line. By adopting such a configuration, the antenna elements and the main unit portion of the passive element are each disposed with good balance, so it is possible to suppress gain variations while reducing the amount of interconnection between the antenna elements.

In the aforementioned configuration in which the main unit portion is provided in a substantially line symmetrical shape with respect to the reference straight line, it is preferable that the branch portion branch from a position at ½ of the full length of the main unit portion or substantially ½ of the full length of the main unit portion provided in a substantially line symmetrical shape with respect to the reference straight line and be provided in a bent or curved shape. With such a configuration, the bent or curved shape of the branch portion makes it possible to easily ensure the length required for the branch portion, so the expansion of the installation space required by the branch portion can be suppressed. Furthermore, compared to a case in which the branch portion is arranged in a rectilinear manner, it is possible to easily make adjustments so as to match the position of the resonance point of the passive element to a desired frequency.

In the multi-band compatible multi-antenna device according to the third preferred embodiment of the present invention, it is preferable that the first antenna element, the second antenna element, and the passive element all be shaped so as to be bent or curved at a plurality of positions. If such a configuration is adopted, the respective lengths required for the antenna elements and passive element can be easily ensured by the bent or curved shape of the antenna elements and passive element, so it is possible to prevent the expansion of the installation space for the antenna elements and passive element and, as a result, the multi-antenna device can be miniaturized even further.

In the multi-band compatible multi-antenna device according to the third preferred embodiment of the present invention, it is preferable that the passive element be disposed so as to span across a plurality of surfaces. If such a configuration is adopted, the passive element can be disposed so as to overlap on different surfaces as seen in plan view, so it is possible to dispose the passive element in a smaller space as seen in plan view. Consequently, the multi-antenna device can be miniaturized as seen in plan view. Moreover, because the passive element can be disposed on different surfaces, it is possible to increase the degree of freedom in the arrangement of the equipment internal configuration.

In the multi-band compatible multi-antenna device according to the third preferred embodiment of the present invention, it is preferable that the first antenna element and the second antenna element both correspond to a third frequency band in addition to the first frequency band and the second frequency band, and that the passive element be configured so as to resonate at the frequency corresponding to the third frequency band as well in addition to the frequency corresponding to the first frequency band and the frequency corresponding to the second frequency band. By adopting such a configuration, it is possible to obtain a multi-antenna device compatible with a triple band which can be miniaturized by reducing the distance between the antenna elements.

In the multi-band compatible multi-antenna device according to the third preferred embodiment of the present invention, it is preferable that this multi-antenna device further include matching circuits which are respectively disposed on the side of the first antenna element and on the side of the second antenna element, between the antenna elements and the feeding points having high-frequency power supplied thereto and which are used to achieve impedance matching at the frequency corresponding to the first frequency band and the frequency corresponding to the second frequency band of the high-frequency power. By adopting such a configuration, the matching circuits make it possible to achieve impedance matching at the frequency corresponding to the first frequency band and the frequency corresponding to the second frequency band, so it is possible to reduce transmission loss of the energy transmitted via the antenna elements while miniaturizing the multi-antenna device.

In the multi-band compatible multi-antenna device according to the third preferred embodiment of the present invention, it is preferable that the first antenna element and the second antenna element each include a monopole antenna. By adopting such a configuration, it is possible to miniaturize the multi-band compatible multi-antenna device using a monopole antenna which is smaller than a dipole antenna.

The multi-band compatible communication equipment according to a fourth preferred embodiment of the present invention is communication equipment including a multi-band compatible multi-antenna device, wherein the multi-band compatible multi-antenna device includes a first antenna element corresponding to a first frequency band and a second frequency band, a second antenna element corresponding to the first frequency band and the second frequency band, and a single passive element which is disposed between the first antenna element and the second antenna element and which resonates at both the frequency corresponding to the first frequency band and the frequency corresponding to the second frequency band.

In the multi-band compatible communication equipment according to the fourth preferred embodiment of the present invention, by providing a single passive element which resonates at both the frequency corresponding to the first frequency band and the frequency corresponding to the second frequency band between the first antenna element and the second antenna element as described above, it is possible to reduce the amount of interconnection between the antenna elements. In addition, because the amount of interconnection between the first antenna element and the second antenna element can be reduced, the distance between the antenna elements can be correspondingly reduced and, as a result, it is possible to miniaturize the multi-band compatible multi-antenna device.

Consequently, in accordance with the above described preferred embodiments, miniaturization of the communication equipment itself including such a multi-band compatible multi-antenna device is also possible. Accordingly, this communication equipment can be miniaturized by reducing the distance between the antenna elements. Preferred embodiments of the present invention are particularly effective for communication equipment in relation to which there is a demand for miniaturization such as, for example, with mobile phones.

The above and other elements, features, steps, characteristics and advantages of the present invention will become more apparent from the following detailed description of the preferred embodiments with reference to the attached drawings.

DETAILED DESCRIPTION OF EMBODIMENTS

Preferred embodiments of the present invention will be described below with respect to the drawings.

First Preferred Embodiment

First, the configuration of the mobile phone 100 according to a first preferred embodiment of the present invention will be described with reference to FIGS. 1 and 2. Note that in the first preferred embodiment, an example will be described in which the multi-antenna device 10 of the present invention is applied to the mobile phone 100 which is used as the communication equipment.

Figure 1:
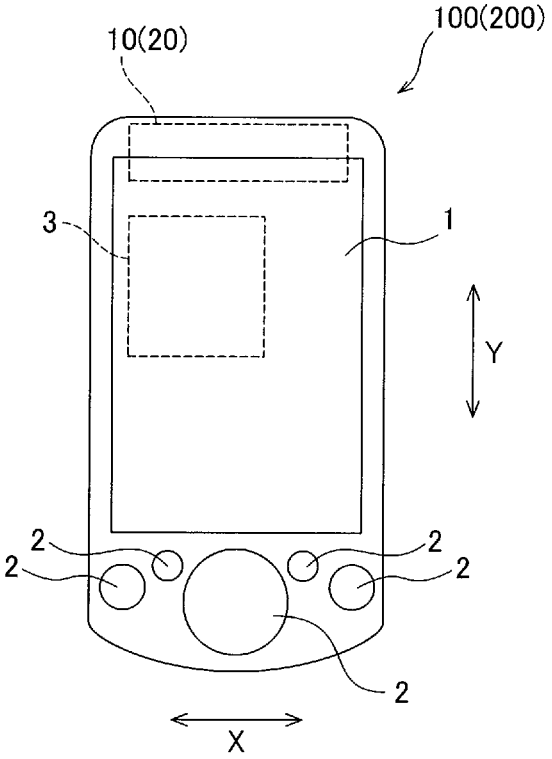
FIG. 1 is a plan view showing the overall configuration of a mobile phone according to first through fourth preferred embodiments of the present invention.

As is shown in FIG. 1, the mobile phone 100 according to the first preferred embodiment of the present invention includes a display screen portion 1 and operating portions 2. Furthermore, a communication portion 3 and a multi-band compatible multi-antenna device 10 are provided inside the housing of the mobile phone 100.

The display screen portion 1 is preferably provided by a liquid crystal display and is configured so as to be able to display images. The operating portions 2 are preferably defined by, for example, a plurality of buttons, touch pads, etc. and are configured to be able to receive user operations. The communication portion 3 is configured so as to perform communication using the electric waves sent and received by the multi-antenna device 10.

The multi-antenna device 10 is preferably configured for MIMO (Multiple-Input Multiple-Output) communication in which multiple input/output is possible at specified frequencies by using a plurality of antenna elements. Moreover, the multi-antenna device 10 is preferably compatible with two different bands (frequency bands): the 1.5 GHz band and the 2.0 GHz band. Note that the 1.5 GHz band is one example of the "first frequency band" of the present invention, and the 2.0 GHz band is one example of the "second frequency band" according to a preferred embodiment of the present invention.

Figure 2:
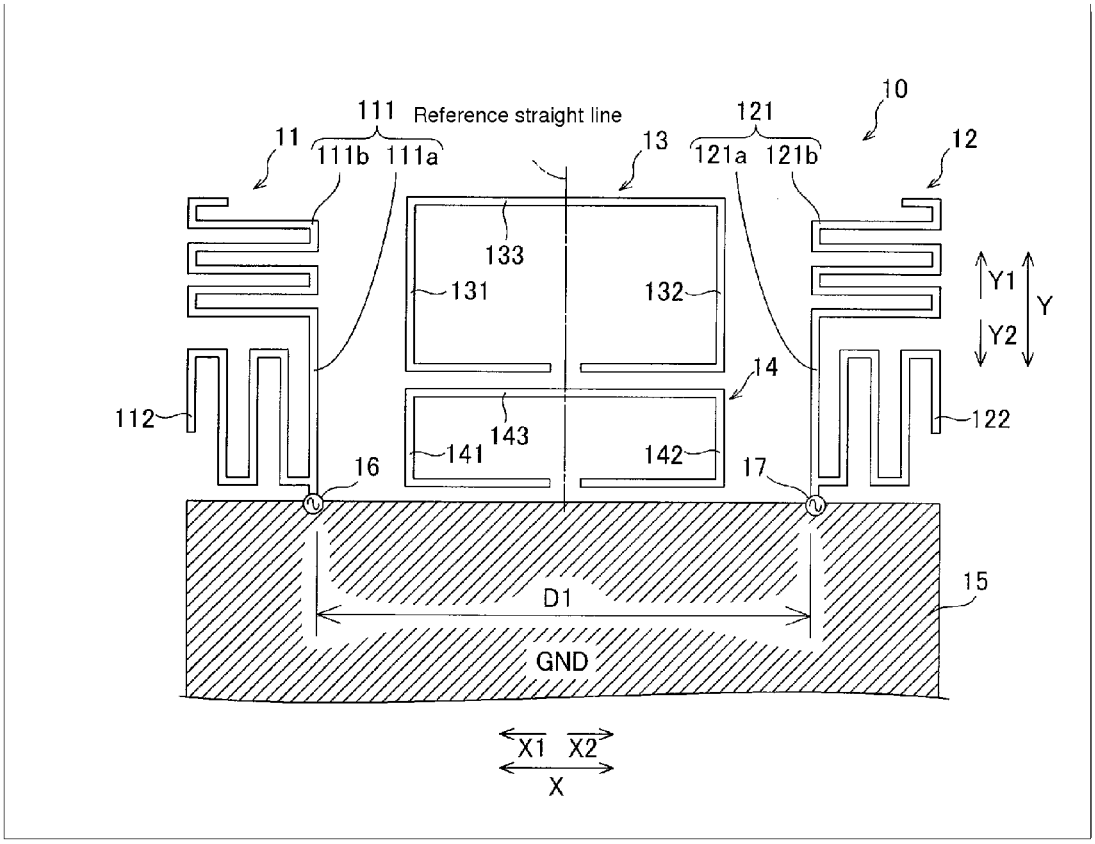
FIG. 2 is a plan view showing the multi-antenna device of the mobile phone according to the first preferred embodiment of the present invention.

As is shown in FIG. 2, the multi-antenna device 10 preferably includes a first antenna element 11, a second antenna element 12, a first passive element 13, and a second passive element 14 that are disposed between the two antenna elements 11 and 12, and a ground surface 15. The multi-antenna device 10 further includes a first feeding point 16 arranged to supply high-frequency power to the first antenna element 11 and a second feeding point 17 arranged to supply high-frequency power to the second antenna element 12. In addition, the first antenna element 11, the second antenna element 12, the first passive element 13, and the second passive element 14 are all provided on the front-side surface of a substrate, which is not illustrated. That is, the first antenna element 11, the second antenna element 12, the first passive element 13, and the second passive element 14 are disposed within the same plane. Note that the first feeding point 16 and the second feeding point 17 are examples of the "feeding points" according to a preferred embodiment of the present invention.

The first antenna element 11 is disposed at the X1 direction side of the first passive element 13 and the second passive element 14, and the second antenna element 12 is disposed at the X2 direction side of the first passive element 13 and the second passive element 14. Furthermore, the first antenna element 11 and the second antenna element 12 preferably are provided in a line symmetrical shape with respect to each other and to a reference straight line which is perpendicular or substantially perpendicular to the straight line connecting the first feeding point 16 and the second feeding point 17 and which passes through the midpoint between the first feeding point 16 and the second feeding point 17. Moreover, the first antenna element 11 (second antenna element 12) preferably has a thin plate shape. In addition, the first antenna element 11 (second antenna element 12) is preferably a monopole antenna. In concrete terms, the first antenna element 11 (second antenna element 12) preferably includes a first frequency band corresponding unit 111 (121), which includes a first branch of the first antenna element 11 (second antenna element 12) and has an electrical length equal or approximately equal to ¼ of the 1.5 GHz wavelength λ1, and a second frequency band corresponding unit 112 (122), which includes a second branch of the first antenna element 11 (second antenna element 12) and has an electrical length equal or approximately equal to ¼ of the 2.0 GHz wavelength λ2, with the multi-antenna device 10 being compatible with both of these bands. Note that the 1.5 GHz wavelength is 200 mm, and the 2.0 GHz wavelength is 150 mm. Furthermore, the electrical length is preferably a length that has 1 wavelength of the signal that progresses on the conductor constituting the antenna as a standard, rather than 1 wavelength in a vacuum. The first frequency band corresponding unit 111 (121) and the second frequency band corresponding unit 112 (122) both have one end portion open, and the other end portion grounded to the ground surface 15 via the first feeding point 16 (second feeding point 17). Moreover, the first frequency band corresponding unit 111 (121) and the second frequency band corresponding unit 112 (122) preferably are provided integrally with each other as a single monolithic member, for example.

The first frequency band corresponding unit 111 (121) preferably includes a power supply connection portion 111*a* (121*a*) connected to the first feeding point 16 (second feeding point 17) and a main unit portion 111*b* (121*b*) linked to the power supply connection portion 111*a* (121*a*). The power supply connection portion 111*a* (121*a*) of the first frequency band corresponding unit 111 (121) preferably is provided in a rectilinear shape so as to extend in the Y1 direction from the first feeding point 16 (second feeding point 17). That is, the power supply connection portion 111*a* of the first antenna element 11 and the power supply connection portion 121*a* of the second antenna element 12 are disposed in parallel or substantially in parallel to each other.

The main unit portion 111*b* (121*b*) is linked to the end portion of the power supply connection portion 111*a* (121*a*) on the side (at the Y1 direction side) opposite from the side on which the first feeding point 16 (second feeding point 17) is provided. In addition, the main unit portion 111*b* (121*b*) is disposed on the side (at the Y1 direction side) of the second frequency band corresponding unit 112 (122) opposite from the side on which the first feeding point 16 (second feeding point 17) is disposed (at the Y2 direction side). Furthermore, the main unit portion 111*b* (121*b*) is configured so as to extend in the Y1 direction while being folded at a plurality of positions in the X direction (in the direction in which the first antenna element 11 and the second antenna element 12 face each other). That is, the main unit portion 111*b* (121*b*) is shaped so as to be bent at a plurality of positions. Moreover, the inner end portion (the end portion on the side on which the first passive element 13 is disposed) of the main unit portion 111*b* (121*b*) in the X direction is disposed so as to be flush with the inner end portion of the power supply connection portion 111*a* (121*a*). In addition, the configuration is such that the full length of the main unit portion 111*b* (121*b*) is longer than the full length of the power supply connection portion 111*a* (121*a*).

The second frequency band corresponding unit 112 (122) is configured so as to extend to the outside (the opposite side from the side on which the second passive element 14 is disposed) while being folded at a plurality of positions in the Y direction (in the direction orthogonal to the direction in which the first antenna element 11 and the second antenna element 12 face each other). That is, the second frequency band corresponding unit 112 (122) is shaped so as to be bent at a plurality of positions. Furthermore, the second frequency band corresponding unit 112 (122) is disposed on the outside of the power supply connection portion 111*a* (121*a*) of the first frequency band corresponding unit 111 (121). Moreover, the second frequency band corresponding unit 112 (122) is disposed so as to be adjacent to the main unit portion 111*b* (121*b*) of the first frequency band corresponding unit 111 (121) at the Y2 direction side of the main unit portion 111*b* (121*b*). In addition, the second frequency band corresponding unit 112 (122) is disposed in an area enclosed by the power supply connection portion 111*a* (121*a*) and main unit portion 111*b* (121*b*) of the first frequency band corresponding unit 111 (121). Furthermore, the outer end portion of the second frequency band corresponding unit 112 (122) is disposed so as to be flush with the outer end portion of the main unit portion 111*b* (121*b*) of the first frequency band corresponding unit 111 (121).

The first passive element 13 preferably is bent at a plurality of positions and provided substantially in the shape of the letter C as a whole. Moreover, the first passive element 13 preferably is arranged in a line symmetrical shape with respect to the aforementioned reference straight line. In addition, the first passive element 13 preferably includes a first coupling portion 131 that is disposed at a distance which allows coupling with the first antenna element 11, a second coupling portion 132 that is disposed at a distance which allows coupling with the second antenna element 12, and a connection portion 133 that connects the first coupling portion 131 and the second coupling portion 132 to each other. Furthermore, the first passive element 13 is disposed between the first antenna element 11 and the second antenna element 12 in an area between the straight line connecting the Y1 direction-side end portions of the first antenna element 11 and second antenna element 12 and the straight line connecting the Y2 direction-side end portions of the first antenna element 11 and second antenna element 12. That is, the first passive element 13 is disposed within an area in which the first antenna element 11 and the second antenna element 12 face each other. Moreover, the first passive element 13 is disposed between the respective main unit portions 111*b* and 121*b* of the first antenna element 11 and second antenna element 12 in an area corresponding to the main unit portions 111*b* and 121*b*. In addition, the first passive element 13 is preferably provided in an ungrounded state, such that the first passive element 13 is not grounded to the ground surface 15. Furthermore, the first passive element 13 preferably has an electrical length equal or approximately equal to ½ of the 1.5 GHz wavelength λ1 to which the first frequency band corresponding unit 111 (121) corresponds. Moreover, the first passive element 13 is preferably configured so as to resonate at the frequency corresponding to the 1.5 GHz band (frequency near 1.5 GHz). Note that in the first preferred embodiment, coupling refers to the concept of electromagnetic coupling that includes both capacitive coupling and magnetic coupling.

The first coupling portion 131 and the second coupling portion 132 are both arranged substantially in the shape of the letter L by the portion extending in the Y direction and the portion extending in the X direction from the Y2 direction-side end portion of the portion [extending in the Y direction]. In addition, the first coupling portion 131 (second coupling portion 132) is disposed such that the portion extending in the Y direction faces the main unit portion 111*b* of the first antenna element 11 (main unit portion 121*b* of the second antenna element 12). Furthermore, the first coupling portion 131 (second coupling portion 132) is disposed such that the portion extending in the Y direction also faces a portion of the power supply connection portion 111*a* of the first antenna element 11 (power supply connection portion 121*a* of the second antenna element 12).

The connection portion 133 is configured so as to connect the Y1 direction-side end portion of the first coupling portion 131 and the Y1 direction-side end portion of the second coupling portion 132. Moreover, the connection portion 133 is arranged so as to extend in a rectilinear manner from one side to the other side between the first antenna element 11 and the second antenna element 12 (so as to extend in the X direction).

The second passive element 14 is provided separately from the first passive element 13. In addition, the second passive element 14 is bent at a plurality of positions and arranged substantially in the shape of the letter C as a whole. Furthermore, the second passive element 14 preferably is provided in a line symmetrical shape with respect to the aforementioned reference straight line. Moreover, the second passive element 14 preferably includes a first coupling portion 141 that is disposed at a distance which allows coupling with the first antenna element 11, a second coupling portion 142 that is disposed at a distance which allows coupling with the second antenna element 12, and a connection portion 143 that connects the first coupling portion 141 and the second coupling portion 142 to each other. In addition, the second passive element 14 is disposed between the first antenna element 11 and the second antenna element 12 in an area between the straight line connecting the Y1 direction-side end portions of the first antenna element 11 and second antenna element 12 and the straight line connecting the Y2 direction-side end portions of the first antenna element 11 and second antenna element 12. That is, the second passive element 14 is disposed within an area in which the first antenna element 11 and the second antenna element 12 face each other. Furthermore, the second passive element 14 is disposed between the respective second frequency band corresponding units 112 and 122 of the first antenna element 11 and second antenna element 12 in an area corresponding to the second frequency band corresponding units 112 and 122. Moreover, the second passive element 14 is disposed so as to be adjacent to the first passive element 13 at the Y2 direction side of the first passive element 13. In addition, the second passive element 14 is preferably provided in an ungrounded state, such that the second passive element 14 is not grounded to the ground surface 15. Furthermore, the second passive element 14 has an electrical length equal or approximately equal to ½ of the 2.0 GHz wavelength λ2 to which the second frequency band corresponding unit 112 (122) corresponds. Moreover, the second passive element 14 preferably is configured so as to resonate at the frequency corresponding to the 2.0 GHz band (frequency near 2.0 GHz).

The first coupling portion 141 and the second coupling portion 142 are both preferably provided substantially in the shape of the letter L by the portion extending in the Y direction and the portion extending in the X direction from the Y2 direction-side end portion of the portion extending in the Y direction. In addition, the first coupling portion 141 (second coupling portion 142) is disposed such that the portion extending in the Y direction faces the first antenna element 11 (second antenna element 12). In concrete terms, the first coupling portion 141 (second coupling portion 142) is disposed such that the portion extending in the Y direction faces the power supply connection portion 111*a* of the first antenna element 11 (power supply connection portion 121*a* of the second antenna element 12). The connection portion 143 is configured so as to connect the Y1 direction-side end portion of the first coupling portion 141 and the Y1 direction-side end portion of the second coupling portion 142. Furthermore, the connection portion 143 is arranged so as to extend in a rectilinear manner from one side to the other side between the first antenna element 11 and the second antenna element 12 (so as to extend in the X direction).

The first feeding point 16 (second feeding point 17) is disposed at the Y2 direction-side end portion of the first antenna element 11 (second antenna element 12). Moreover, the first feeding point 16 (second feeding point 17) connects the first antenna element 11 (second antenna element 12) and the feeder line, which is not illustrated.

In the first preferred embodiment, as was described above, as a result of the first passive element 13 which resonates at the frequency corresponding to the 1.5 GHz band being provided between the first antenna element 11 and the second antenna element 12, and as a result of the second passive element 14 which resonates at the frequency corresponding to the 2.0 GHz band being provided between the first antenna element 11 and the second antenna element 12 separately from the first passive element 13, it is possible to reduce the amount of interconnection between the antenna elements. In addition, because the amount of interconnection between the first antenna element 11 and the second antenna element 12 can be reduced, the distance between the antenna elements can be reduced correspondingly and, as a result, it is possible to miniaturize the multi-band compatible multi-antenna device 10. Consequently, it is also possible to miniaturize a mobile phone 100 including such a multi-band compatible multi-antenna device 10. Accordingly, this mobile phone 100 can be miniaturized by reducing the distance between the antenna elements. Preferred embodiments of the present invention are particularly more effective with communication equipment in relation to which there is a demand for miniaturization such as the mobile phone 100 of the first preferred embodiment. Note that the effect of being able to reduce the amount of interconnection between antenna elements through the aforementioned configuration has been confirmed through simulation which will be described later.

Furthermore, in the first preferred embodiment, as was described above, the first passive element 13 and the second passive element 14 are preferably both provided so as to be ungrounded. With such a configuration, because it is not necessary to ground the first passive element 13 and the second passive element 14 to the ground surface 15, it is possible to prevent the decrease in the degree of freedom in wiring pattern design.

Moreover, in the first preferred embodiment, as was described above, the first passive element 13 is configured so as to have an electrical length equal or substantially equal to ½ of the wavelength λ1 of the electric wave that is output corresponding to the 1.5 GHz band by the first antenna element 11 and the second antenna element 12, and the second passive element 14 is configured so as to have an electrical length equal or substantially equal to ½ of the wavelength λ2 of the electric wave that is output corresponding to the 2.0 GHz band by the first antenna element 11 and the second antenna element 12. By adopting such a configuration, it is possible to easily have the ungrounded first passive element 13 and second passive element 14 resonate at the frequency corresponding to the 1.5 GHz band and the frequency corresponding to the 2.0 GHz band.

In addition, in the first preferred embodiment, as was described above, the second passive element 14 is disposed between the second frequency band corresponding units 112 and 122 of the first antenna element 11 and second antenna element 12 in an area corresponding to the second frequency band corresponding units 112 and 122. With such a configuration, the second passive element 14 and the second frequency band corresponding units 112 and 122 can be disposed more closely, so it is possible to easily couple the second passive element 14 and the second frequency band corresponding units 112 and 122.

In addition, in the first preferred embodiment, as was described above, the second passive element 14 is disposed between the second frequency band corresponding units 112 and 122 of the first antenna element 11 and second antenna element 12 in an area corresponding to the second frequency band corresponding units 112 and 122, and the first passive element 13 is disposed between the main unit portions 111*b* and 121*b* of the first frequency band corresponding units 111 and 121 of the first antenna element 11 and second antenna element 12 in an area corresponding to the main unit portions 111*b* and 121*b*. If such a configuration is adopted, the second passive element 14 and the second frequency band corresponding units 112 and 122 can be caused to couple easily by disposing the second passive element 14 and the second frequency band corresponding units 112 and 122 more closely, and the first passive element 13 and the first frequency band corresponding units 111 and 121 can be caused to couple easily by disposing the first passive element 13 and the main unit portions 111*b* and 121*b* of the first frequency band corresponding units 111 and 121 more closely.

Furthermore, in the first preferred embodiment, as was described above, the first antenna element 11 and the second antenna element 12 are preferably both shaped so as to be bent at a plurality of positions, and the first passive element 13 and the second passive element 14 are both shaped so as to be bent at a plurality of positions between the first antenna element 11 and the second antenna element 12. By adopting such a configuration, the bent shapes of the antenna elements and passive elements make it possible to easily ensure the lengths respectively required for the antenna elements and passive elements, so it is possible to prevent undesirable expansion of the installation space housing the antenna elements and the passive elements and, as a result, it is possible to miniaturize the multi-antenna device 10.

Moreover, in the first preferred embodiment, as was described above, the first antenna element 11, the second antenna element 12, the first passive element 13, and the second passive element 14 preferably are all disposed within the same plane (on the front-side surface of the substrate). With such a configuration, all of the antenna elements and passive elements are disposed within a common plane, so it is possible to simplify the configuration of the multi-antenna device.

In addition, in the first preferred embodiment, as was described above, the first antenna element 11 and the second antenna element 12 preferably are provided in a line symmetrical shape with respect to each other and to the reference straight line which is perpendicular to the straight line that connects the first feeding point 16 and the second feeding point 17 and which passes through the midpoint between the first feeding point 16 and the second feeding point 17, and the first passive element 13 and the second passive element 14 preferably are each provided in a line symmetrical shape with respect to the reference straight line. By adopting such a configuration, the antenna elements and the passive elements are each disposed with good balance, so it is possible to suppress gain variations while reducing the amount of interconnection between the antenna elements.

Furthermore, in the first preferred embodiment, as a result of the first frequency band corresponding unit 111 (121) and the second frequency band corresponding unit 112 (122) being defined integrally with each other as a single monolithic element, unlike a configuration in which a switching element is used to switch the full length of each antenna element and thus to handle the first frequency band and the second frequency band, there is no need to provide a dedicated switching control portion to control the switching element, so it is possible to inhibit the circuit configuration from becoming complex and, as a result, it is possible to miniaturize the space required for the antennas.

Next, the results of a simulation that was performed in order to confirm the effects of the first preferred embodiment will be described. With this simulation, a comparison was made between the multi-band compatible multi-antenna device 10 corresponding to the first preferred embodiment shown in FIG. 2 and the multi-antenna device 110 according to a comparative example shown in FIG. 3.

With the multi-antenna device 10 corresponding to the first preferred embodiment, the first antenna element 11 and the second antenna element 12 were disposed such that a separation distance D1 for the feeding points was about 33 mm, for example. Moreover, with this simulation, the configuration was such that the first antenna element 11, the second antenna element 12, the first passive element 13, and the second passive element 14 were disposed on a glass epoxy substrate having a thickness of about 1 mm, for example, with this substrate being provided in a vacuum. In addition, the first antenna element 11, the second antenna element 12, the first passive element 13, and the second passive element 14 were all configured from a conductor with a thickness of slightly more than about 0 mm, for example. Note that the multi-antenna device 10 corresponding to the first preferred embodiment is compatible with both 1.5 GHz and 2.0 GHz as described above.

Figure 3:
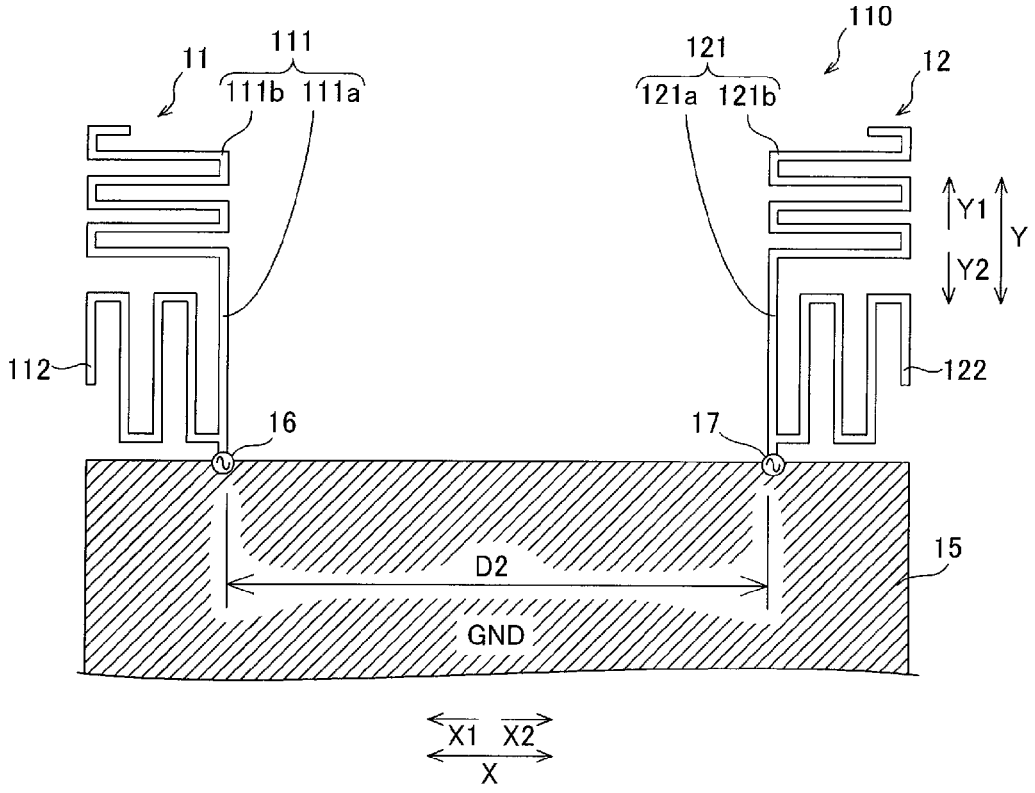
FIG. 3 is a plan view showing the multi-antenna device according to a comparative example.

As is shown in FIG. 3, with the multi-antenna device 110 according to the comparative example, unlike the multi-antenna device 10 according to the first preferred embodiment in which the ungrounded first passive element 13 and second passive element 14 were provided, a configuration was adopted in which no passive element was provided between the two antenna elements 11 and 12. Moreover, with the multi-antenna device 110 according to the comparative example, the first antenna element 11 and the second antenna element 12 were disposed such that the separation distance D2 for the feeding points was 33 mm as in the multi-antenna device 10 corresponding to the first preferred embodiment. In addition, the remainder of the configuration of the multi-antenna device 110 according to the comparative example is the same as that of the multi-antenna device 10 corresponding to the first preferred embodiment.

Next, referring to FIGS. 4 and 5, a description will be given regarding the S parameter characteristics of the multi-antenna device 110 according to the comparative example and the multi-antenna device 10 corresponding to the first preferred embodiment. Here, of the S parameters shown in FIGS. 4 and 5, S11 (S22) indicates the reflection coefficient of the antenna element, and S21 (S12) of the S parameters indicates the strength of the interconnection between the two antenna elements. Furthermore, in FIGS. 4 and 5, the horizontal axis is the frequency, and the vertical axis is the size (unit: dB) of S11 (S22) and S21 (S12).

Figure 4:
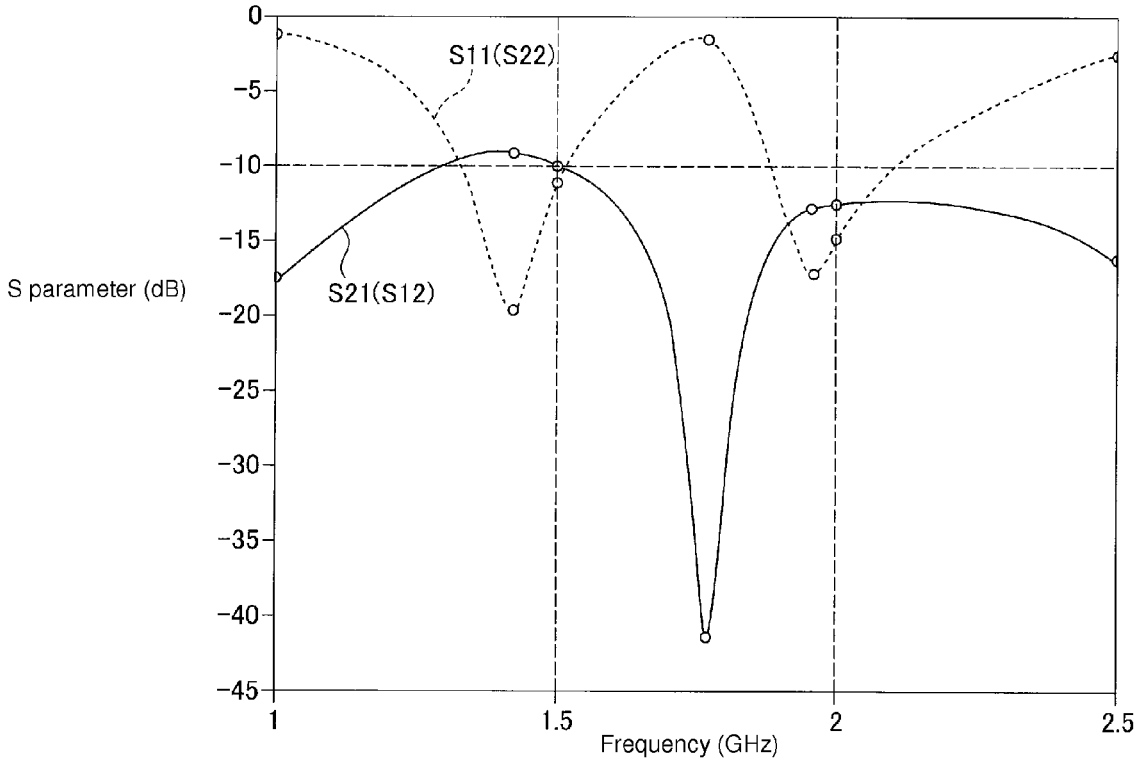
FIG. 4 is a diagram showing the S parameter characteristics with a simulation of the multi-antenna device according to the comparative example.
Figure 5:
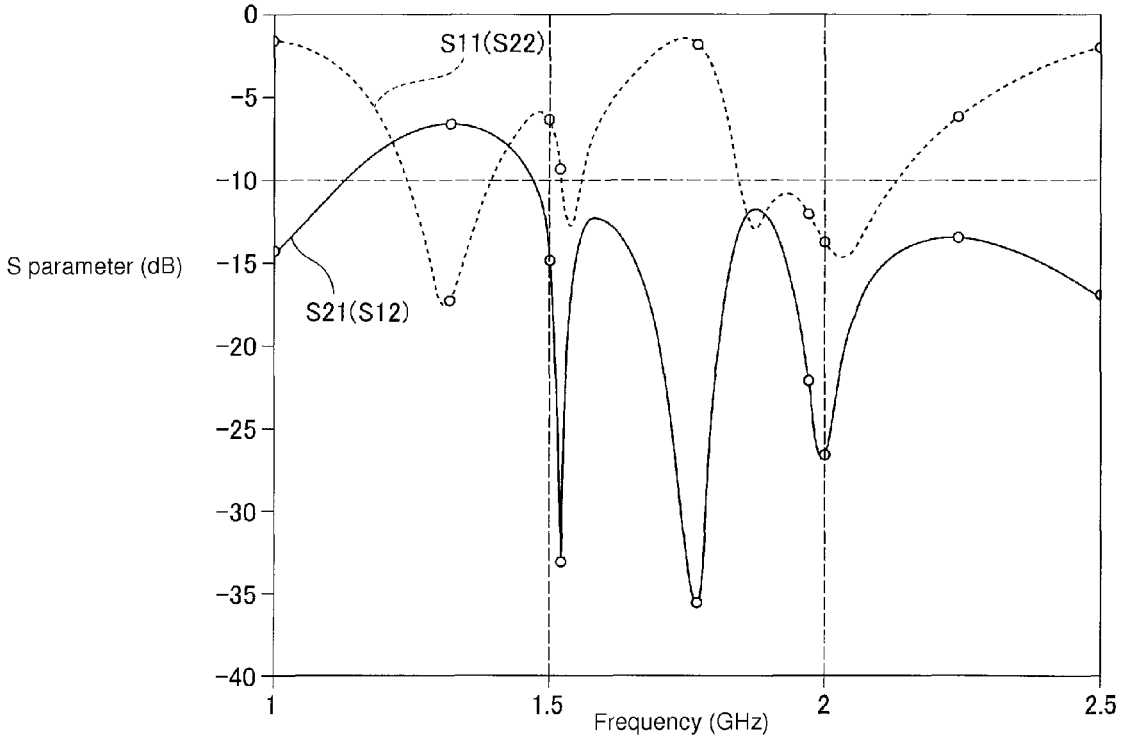
FIG. 5 is a diagram showing the S parameter characteristics with a simulation of the multi-antenna device corresponding to the first preferred embodiment of the present invention.

First, with the multi-antenna device 110 according to the comparative example, the resonance point near 1.5 GHz was 1.4 GHz, at which S11 (S22) was approximately −20 dB, while S21 (S12) was approximately −9 dB as shown in FIG. 4. Moreover, with the multi-antenna device 110 according to the comparative example, the resonance point near 2.0 GHz was 1.9 GHz, at which S11 (S22) was approximately −17 dB, while S21 (S12) was approximately −13 dB. In contrast, with the multi-antenna device 10 corresponding to the first preferred embodiment, the resonance point near 1.5 GHz was 1.55 GHz, at which S11 (S22) was approximately −13 dB, while S21 (S12) was approximately −34 dB as shown in FIG. 5. In addition, with the multi-antenna device 10 corresponding to the first preferred embodiment, the resonance occurred at 2.0 GHz, at which S11 (S22) was approximately −14 dB, while S21 (S12) was approximately −27 dB. Note that the shift in the resonance point between the multi-antenna device 110 according to the comparative example and the multi-antenna device 10 corresponding to the first preferred embodiment is thought to occur due to the presence or absence of electromagnetic coupling between the passive elements and the antenna elements.

As a result, the value of S21 (S12) indicating the strength (size) of the interconnection between the two antenna elements is smaller at both 1.5 GHz and 2.0 GHz with the multi-antenna device 10 corresponding to the first preferred embodiment than with the multi-antenna device 110 according to the comparative example, so it was confirmed that the amount of interconnection between the antenna elements can be reduced by providing the ungrounded first passive element 13 and second passive element 14. Furthermore, in contrast to the fact that with the multi-antenna device 110 according to the comparative example, only one portion at which the value of S21 (S12) rapidly drops (valley portion) occurs in the area between 1.5 GHz and 2.0 GHz as shown in FIG. 4, with the multi-antenna device 10 corresponding to the first preferred embodiment, a portion at which the value of S21 (S12) rapidly drops (valley portion) occurs both near 1.5 GHz and near 2.0 GHz as shown in FIG. 5. That is, with the multi-antenna device 10 corresponding to the first preferred embodiment, at 1.5 GHz and 2.0 GHz, the value of S21 (S12) decreases. Note that if the value of S21 (S12) is −10 dB or less, it is thought that the interconnection between the antenna elements is tiny.

As a reason for the decrease in the value of S21 (S12) at 1.5 GHz, with the multi-antenna device 10 corresponding to the first preferred embodiment, it is thought that this is because at the first frequency band corresponding unit 111 (121) of the first antenna element 11 (second antenna element 12), direct coupling caused by current flowing in the other antenna element and indirect coupling caused by current flowing in the first passive element 13 occur, thereby negating or substantially negating the interconnection between the antenna elements. Moreover, as a reason for the decrease in the value of S21 (S12) at 2.0 GHz, it is thought that this is because at the second frequency band corresponding unit 112 (122) of the first antenna element 11 (second antenna element 12), direct coupling caused by current flowing in the other antenna element and indirect coupling caused by current flowing in the second passive element 14 occur, thereby negating or substantially negating the interconnection between the antenna elements.

Second Preferred Embodiment

Next, referring to FIG. 6, a description will be given regarding the multi-antenna device 20 of the mobile equipment 200 (see FIG. 1) according to a second preferred embodiment of the present invention. In this second preferred embodiment, unlike the aforementioned first preferred embodiment in which the first passive element 13 and the second passive element 14 are both provided substantially in the shape of the letter C, a configuration will be described in which a first passive element 23 and a second passive element 24 are both arranged so as to extend in the X direction while being folded in the Y direction. Note that in the second preferred embodiment, an example will be described in which the multi-antenna device 20 of the present invention is applied to the mobile phone 200 which is used as the communication equipment.

The multi-band compatible multi-antenna device 20 of the mobile equipment 200 (see FIG. 1) according to the second preferred embodiment of the present invention is configured to perform MIMO communication in which multiple input/output is possible at specified frequencies by using a plurality of antenna elements. In addition, the multi-antenna device 20 is compatible with two different bands (frequency bands): the 1.5 GHz band and the 2.0 GHz band. Note that the 1.5 GHz band is one example of the "first frequency band" of a preferred embodiment of present invention, and the 2.0 GHz band is one example of the "second frequency band" of a preferred embodiment of the present invention.

Figure 6:
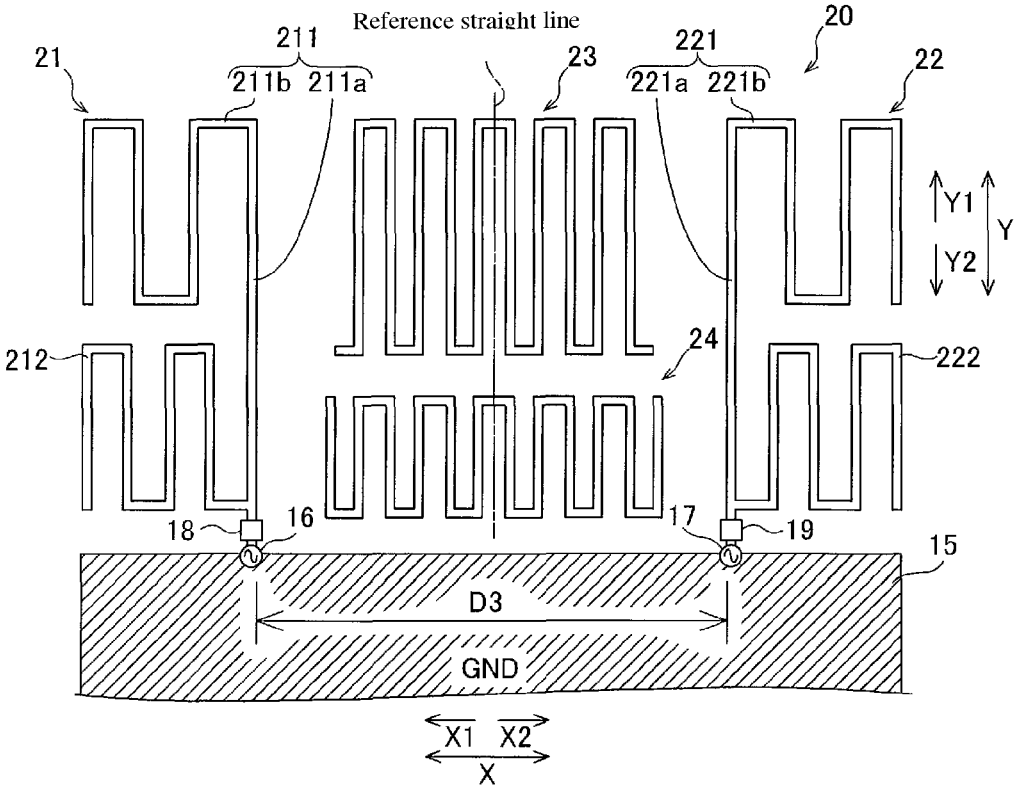
FIG. 6 s a plan view showing the multi-antenna device of the mobile phone according to the second preferred embodiment of the present invention.

As is shown in FIG. 6, the multi-antenna device 20 preferably includes a first antenna element 21, a second antenna element 22, the first passive element 23, and the second passive element 24 that are disposed between the two antenna elements 21 and 22, and the ground surface 15. The multi-antenna device 20 preferably further includes a first feeding point 16 arranged to supply high-frequency power to the first antenna element 21 and a second feeding point 17 arranged to supply high-frequency power to the second antenna element 22, as well as a first matching circuit 18 and a second matching circuit 19 arranged to achieve impedance matching. Furthermore, the first antenna element 21, the second antenna element 22, the first passive element 23, and the second passive element 24 are all preferably provided on the front-side surface of a substrate, which is not illustrated. Note that the first matching circuit 18 and the second matching circuit 19 are examples of the "matching circuits" according to a preferred embodiment of the present invention.

The first antenna element 21 is disposed at the X1 direction side of the first passive element 23 and the second passive element 24, and the second antenna element 22 is disposed at the X2 direction side of the first passive element 23 and the second passive element 24. Moreover, the first antenna element 21 and the second antenna element 22 preferably are provided in a line symmetrical shape with respect to each other and to a reference straight line which is perpendicular or substantially perpendicular to the straight line connecting the first feeding point 16 and the second feeding point 17 and which passes through the midpoint between the first feeding point 16 and the second feeding point 17. In addition, the first antenna element 21 (second antenna element 22) preferably has a thin plate shape. Furthermore, the first antenna element 21 (second antenna element 22) is preferably a monopole antenna. In concrete terms, the first antenna element 21 (second antenna element 22) includes a first frequency band corresponding unit 211 (221) having an electrical length equal or approximately equal to ¼ of the 1.5 GHz wavelength λ1 and a second frequency band corresponding unit 212 (222) having an electrical length equal or approximately equal to ¼ of the 2.0 GHz wavelength λ2, with the multi-antenna device 20 being compatible with both of these bands. The first frequency band corresponding unit 211 (221) and the second frequency band corresponding unit 212 (222) both preferably include one end portion open, and the other end portion grounded to the ground surface 15 via the first feeding point 16 (second feeding point 17). Moreover, the first frequency band corresponding unit 211 (221) and the second frequency band corresponding unit 212 (222) preferably are provided integrally with each other as a single monolithic member.

The first frequency band corresponding unit 211 (221) preferably includes a power supply connection portion 211*a* (221*a*) connected to the first feeding point 16 (second feeding point 17) and a main unit portion 211*b* (221*b*) linked to the power supply connection portion 211*a* (221*a*). The power supply connection portion 211*a* (221*a*) of the first frequency band corresponding unit 211 (221) preferably is arranged in a rectilinear shape so as to extend in the Y1 direction from the first feeding point 16 (second feeding point 17). That is, the power supply connection portion 211*a* of the first antenna element 21 and the power supply connection portion 221*a* of the second antenna element 22 are disposed in parallel or substantially in parallel to each other. The main unit portion 211*b* (221*b*) is linked to the end portion of the power supply connection portion 211*a* (221*a*) on the side (at the Y1 direction side) opposite from the side on which the first feeding point 16 (second feeding point 17) is provided. In addition, the main unit portion 211*b* (221*b*) is disposed on the side (at the Y1 direction side) of the second frequency band corresponding unit 212 (222) opposite from the side on which the first feeding point 16 (second feeding point 17) is disposed (at the Y2 direction side). Moreover, the main unit portion 211*b* (221*b*) is preferably configured so as to extend to the outside (to the side opposite from the side on which the first passive element 23 is disposed) while being folded at a plurality of positions in the Y direction. That is, the main unit portion 211*b* (221*b*) is shaped so as to be bent at a plurality of positions. In addition, the inner end portion (the end portion on the side on which the first passive element 23 is disposed) of the main unit portion 211*b* (221*b*) in the X direction is disposed so as to be flush with the inner end portion of the power supply connection portion 211*a* (221*a*). Furthermore, the configuration is such that the full length of the main unit portion 211*b* (221*b*) is longer than the full length of the power supply connection portion 211*a* (221*a*).

The second frequency band corresponding unit 212 (222) is configured so as to extend to the outside (to the side opposite from the side on which the second passive element 24 is disposed) while being folded at a plurality of positions in the Y direction. That is, the second frequency band corresponding unit 212 (222) is preferably shaped so as to be bent at a plurality of positions. Moreover, the second frequency band corresponding unit 212 (222) is preferably disposed on the outside of the power supply connection portion 211*a* (221*a*) of the first frequency band corresponding unit 211 (221). In addition, the second frequency band corresponding unit 212 (222) is disposed so as to be adjacent to the main unit portion 211*b* (221*b*) of the first frequency band corresponding unit 211 (221) at the Y2 direction side of the main unit portion 211*b* (221*b*). Furthermore, the second frequency band corresponding unit 212 (222) is disposed in an area enclosed by the power supply connection portion 211*a* (221*a*) and main unit portion 211*b* (221*b*) of the first frequency band corresponding unit 211 (221). Moreover, the outer end portion of the second frequency band corresponding unit 212 (222) is disposed so as to be flush with the outer end portion of the main unit portion 211*b* (221*b*) of the first frequency band corresponding unit 211 (221).

The first passive element 23 is shaped so as to be bent at a plurality of positions. In concrete terms, the first passive element 23 is arranged so as to extend in the X direction (i.e., in the direction in which the first antenna element 21 and the second antenna element 22 face each other) while being folded at a plurality of positions in the Y direction. In addition, the first passive element 23 preferably is provided in a line symmetrical shape with respect to the aforementioned reference straight line. Furthermore, the first passive element 23 is disposed at a distance which allows coupling with both the first antenna element 21 and the second antenna element 22. Moreover, the first passive element 23 is such that the two end portions respectively face the first antenna element 21 and the second antenna element 22. In concrete terms, the two end portions of the first passive element 23 respectively face the power supply connection portion 211*a* of the first antenna element 21 and the power supply connection portion 221*a* of the second antenna element 22. In addition, the first passive element 23 is disposed between the first antenna element 21 and the second antenna element 22 in an area between the straight line connecting the Y1 direction-side end portions of the first antenna element 21 and second antenna element 22 and the straight line connecting the Y2 direction-side end portions of the first antenna element 21 and second antenna element 22. That is, the first passive element 23 is disposed within an area in which the first antenna element 21 and the second antenna element 22 face each other. Furthermore, the first passive element 23 is disposed between the respective main unit portions 211*b* and 221*b* of the first antenna element 21 and second antenna element 22 in an area corresponding to the main unit portions 211*b* and 221*b*. Moreover, the first passive element 23 is provided in an ungrounded state, not grounded to the ground surface 15. In addition, the first passive element 23 has an electrical length equal or approximately equal to ½ of the 1.5 GHz wavelength λ1 to which the first frequency band corresponding unit 211 (221) corresponds. Furthermore, the first passive element 23 is configured so as to resonate at the frequency corresponding to the 1.5 GHz band (frequency near 1.5 GHz). Note that in the second preferred embodiment, coupling refers to the concept of electromagnetic coupling that includes both capacitive coupling and magnetic coupling.

The second passive element 24 is provided separately from the first passive element 23. Moreover, the second passive element 24 is shaped so as to be bent at a plurality of positions. In concrete terms, the second passive element 24 preferably is arranged so as to extend in the X direction (in the direction in which the first antenna element 21 and the second antenna element 22 face each other) while being folded at a plurality of positions in the Y direction. In addition, the second passive element 24 is provided in a line symmetrical shape with respect to the aforementioned reference straight line. Furthermore, the second passive element 24 is disposed at a distance which allows coupling with both the first antenna element 21 and the second antenna element 22. Moreover, the two end portions of the second passive element 24 are arranged so as to extend in the Y direction and respectively face the first antenna element 21 and the second antenna element 22. In concrete terms, the two end portions of the second passive element 24 respectively face the power supply connection portion 211*a* of the first antenna element 21 and the power supply connection portion 221*a* of the second antenna element 22. In addition, the second passive element 24 is disposed between the first antenna element 21 and the second antenna element 22 in an area between the straight line connecting the Y1 direction-side end portions of the first antenna element 21 and second antenna element 22 and the straight line connecting the Y2 direction-side end portions of the first antenna element 21 and second antenna element 22. That is, the second passive element 24 is disposed within an area in which the first antenna element 21 and the second antenna element 22 face each other. Furthermore, the second passive element 24 is disposed between the respective second frequency band corresponding units 212 and 222 of the first antenna element 21 and second antenna element 22 in an area corresponding to the second frequency band corresponding units 212 and 222. Moreover, the second passive element 24 is disposed so as to be adjacent to the first passive element 23 at the Y2 direction side of the first passive element 23. In addition, the second passive element 24 is provided in an ungrounded state, not grounded to the ground surface 15. Furthermore, the second passive element 24 has an electrical length equal or approximately equal to ½ of the 2.0 GHz wavelength λ2 to which the second frequency band corresponding unit 212 (222) corresponds. Moreover, the second passive element 24 is configured so as to resonate at the frequency corresponding to the 2.0 GHz band (frequency near 2.0 GHz).

Figure 7:
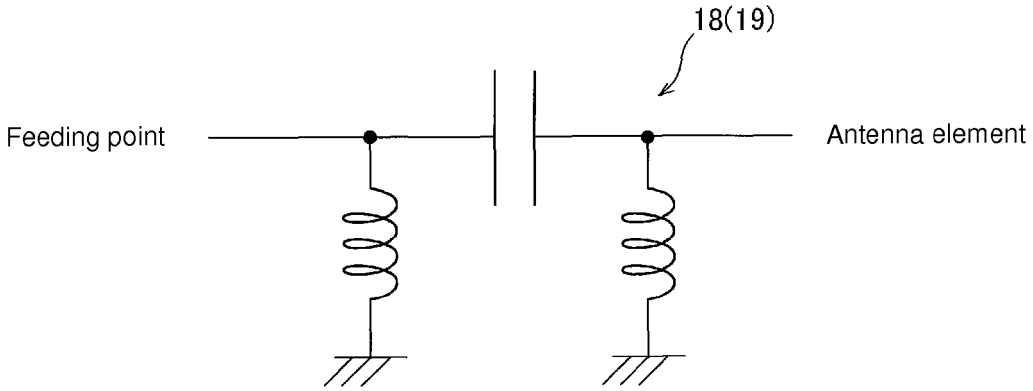
FIG. 7 is a schematic diagram showing a π-type matching circuit used in the multi-antenna device of the mobile phone according to the second preferred embodiment of the present invention.

The first matching circuit 18 (second matching circuit 19) is preferably disposed between the first antenna element 21 (second antenna element 22) and the first feeding point 16 (second feeding point 17). In addition, the first matching circuit 18 (second matching circuit 19) is preferably configured so as to achieve impedance matching at 1.5 GHz and 2.0 GHz with which the multi-antenna device 20 is compatible. In concrete terms, as is shown in FIG. 7, the first matching circuit 18 (second matching circuit 19) is preferably configured by a π-type matching circuit (π match) configured from an inductor (coil) and a capacitor.

Note that the remainder of the configuration of the second preferred embodiment preferably is the same or substantially the same as that of the aforementioned first preferred embodiment.

In the second preferred embodiment, as was described above, as a result of the first passive element 23 which resonates at the frequency corresponding to the 1.5 GHz band being provided between the first antenna element 21 and the second antenna element 22, and as a result of the second passive element 24 which resonates at the frequency corresponding to the 2.0 GHz band being provided between the first antenna element 21 and the second antenna element 22 separately from the first passive element 23, the amount of interconnection between the antenna elements can be reduced in the same manner as in the first preferred embodiment. As a result, it is possible to reduce the distance between the antenna elements and thus to miniaturize the multi-band compatible multi-antenna device 20. Specifically, with the configuration of the second preferred embodiment as well, in which the first passive element 23 and the second passive element 24 are both arranged so as to extend in the X direction (in the direction in which the first antenna element 21 and the second antenna element 22 face each other) while being folded in the Y direction, it is possible to reduce the distance between the antenna elements and thus to miniaturize the multi-band compatible multi-antenna device 20 in the same manner as in the first preferred embodiment. Note that the effect of being able to reduce the amount of interconnection between the antenna elements through the aforementioned configuration has been confirmed by simulation which will be described later.

Furthermore, in the second preferred embodiment, as was described above, the first matching circuit 18 arranged to achieve impedance matching at 1.5 GHz and 2.0 GHz is preferably provided between the first antenna element 21 and the first feeding point 16, and the second matching circuit 19 arranged to achieve impedance matching at 1.5 GHz and 2.0 GHz is preferably provided between the second antenna element 22 and the second feeding point 17. By adopting such a configuration, impedance matching can be achieved at 1.5 GHz and 2.0 GHz by the first matching circuit 18 (second matching circuit 19), so it is possible to reduce the transmission loss of the energy transmitted via the antenna elements while achieving the miniaturization of the multi-antenna device 20.

Note that the other advantageous effects of the second preferred embodiment are the same as those of the first preferred embodiment.

Next, the results of the simulation performed in order to confirm the effects of the second preferred embodiment will be described. With this simulation, the multi-band compatible multi-antenna device 20 corresponding to the second preferred embodiment shown in FIG. 6 and the multi-antenna device 110 according to the comparative example shown in FIG. 3 were compared.

With the multi-antenna device 20 corresponding to the second preferred embodiment, the first antenna element 21 and the second antenna element 22 were disposed such that the separation distance D3 for the feeding points was about 23 mm, for example. Note that the multi-antenna device 20 corresponding to the second preferred embodiment is compatible with both 1.5 GHz and 2.0 GHz. Moreover, the remainder of the configuration of the multi-antenna device 20 corresponding to the second preferred embodiment is the same as that of the multi-antenna device 10 corresponding to the aforementioned first preferred embodiment.

Figure 8:
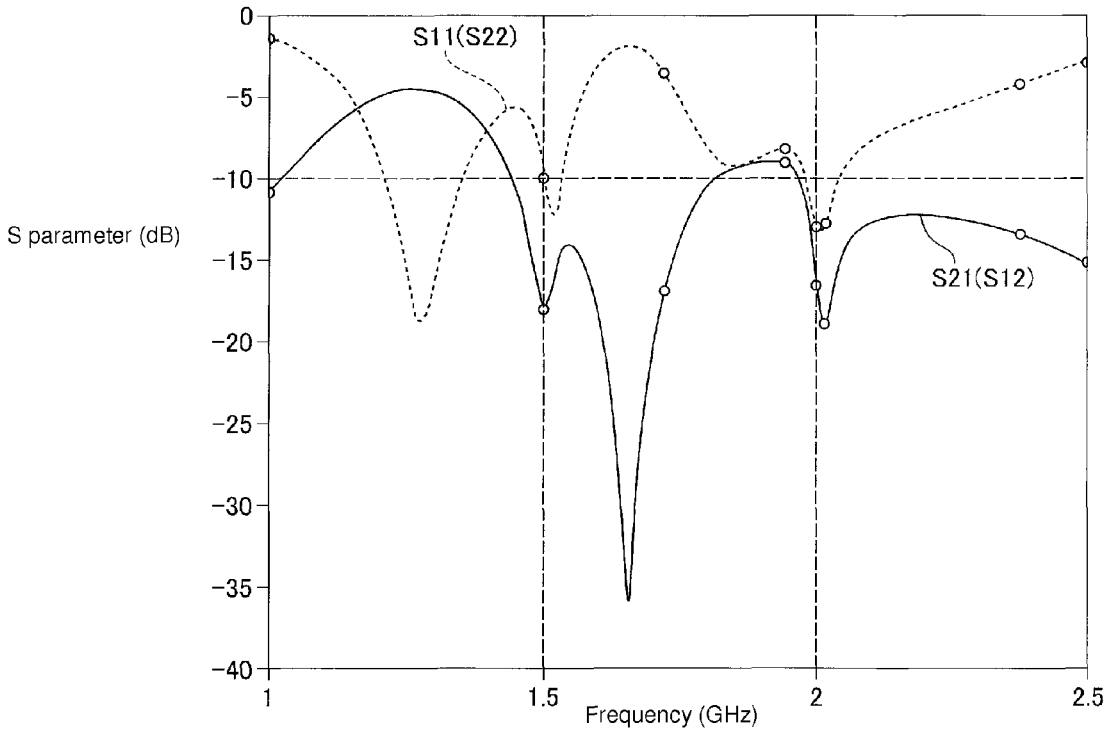
FIG. 8 is a diagram showing the S parameter characteristics with a simulation of the multi-antenna device corresponding to the second preferred embodiment of the present invention.

Next, while referring to FIGS. 4 and 8, a description will be given regarding the S parameter characteristics of the multi-antenna device 110 according to the comparative example and the multi-antenna device 20 corresponding to the second preferred embodiment.

First, with the multi-antenna device 110 according to the comparative example, the resonance point near 1.5 GHz was 1.4 GHz, at which S11 (S22) was approximately −20 dB, while S21 (S12) was approximately −9 dB. In addition, with the multi-antenna device 110 according to the comparative example, the resonance point near 2.0 GHz was 1.9 GHz, at which S11 (S22) was approximately −17 dB, while S21 (S12) was approximately −13 dB. In contrast, with the multi-antenna device 20 corresponding to the second preferred embodiment, at 1.5 GHz, S11 (S22) was approximately −10 dB, while S21 (S12) was approximately −18 dB as shown in FIG. 8. Furthermore, with the multi-antenna device 20 corresponding to the second preferred embodiment, at 2.0 GHz, S11 (S22) was approximately −13 dB, while S21 (S12) was approximately −16 dB. Note that the shift in the resonance point with the multi-antenna device 110 according to the comparative example and the multi-antenna device 20 corresponding to the second preferred embodiment is thought to occur due to the presence or absence of electromagnetic coupling between the passive elements and the antenna elements.

As a result, the value of S21 (S12) indicating the strength (size) of the interconnection between the two antenna elements is smaller at both 1.5 GHz and 2.0 GHz with the multi-antenna device 20 corresponding to the second preferred embodiment than with the multi-antenna device 110 according to the comparative example, so it was confirmed that the amount interconnection between the antenna elements can be reduced by providing the ungrounded first passive element 23 and second passive element 24. Moreover, in contrast to the fact that with the multi-antenna device 110 according to the comparative example, only one portion at which the value of S21 (S12) rapidly drops (valley portion) occurs in the area between 1.5 GHz and 2.0 GHz as shown in FIG. 4, with the multi-antenna device 20 corresponding to the second preferred embodiment, a portion at which the value of S21 (S12) rapidly drops (valley portion) occurs both near 1.5 GHz and near 2.0 GHz in the same manner as in the multi-antenna device 10 of the aforementioned first preferred embodiment. That is, with the multi-antenna device 20 corresponding to the second preferred embodiment, at 1.5 GHz and 2.0 GHz, the value of S21 (S12) decreases.

Modifications of the First and Second Preferred Embodiments

Note that the specific features of the first and second preferred embodiments disclosed above are shown as examples in all respects and should be considered to be non-restrictive. The scope of the preferred embodiments of the present invention is indicated not by the descriptions of the aforementioned preferred embodiments but rather includes all modifications with an equivalent meaning to the scope of the aforementioned preferred embodiments.

For example, in the aforementioned first and second preferred embodiments, an example was described in which the multi-antenna device of the present invention is applied to a mobile phone, but the present invention is not limited to this. For instance, the multi-antenna device of the present invention may also be applied to, for example, a PDA (Personal Digital Assistant), a notebook computer, communication equipment other than a mobile phone such as a wireless router, etc.

In addition, in the first and second preferred embodiments, multi-antenna devices for MIMO communication were shown as examples of a multi-antenna device, but the present invention is not limited to these. With the present invention, for example, it is also possible for it to be a multi-antenna device compatible with a system other than MIMO, such as, for example, a diversity system.

Figure 9:
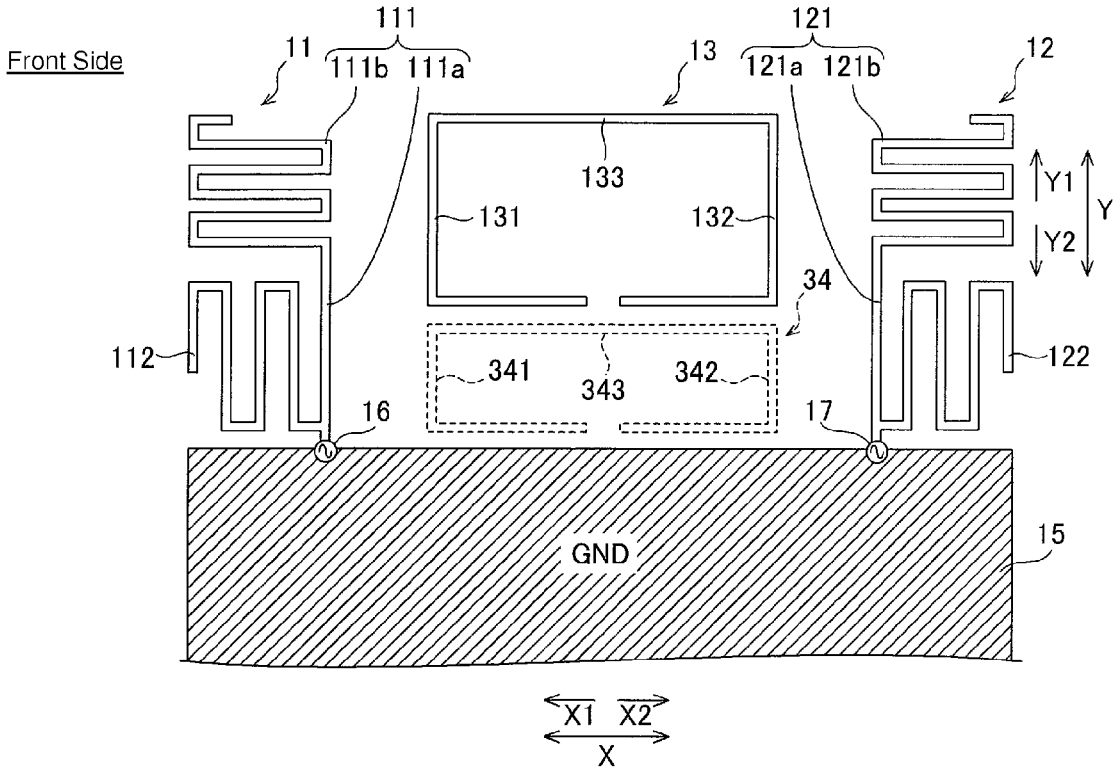
FIG. 9 is a plan view showing the front side of the substrate of the multi-antenna device according to a first modified example of the first and second preferred embodiments of the present invention.
Figure 10:
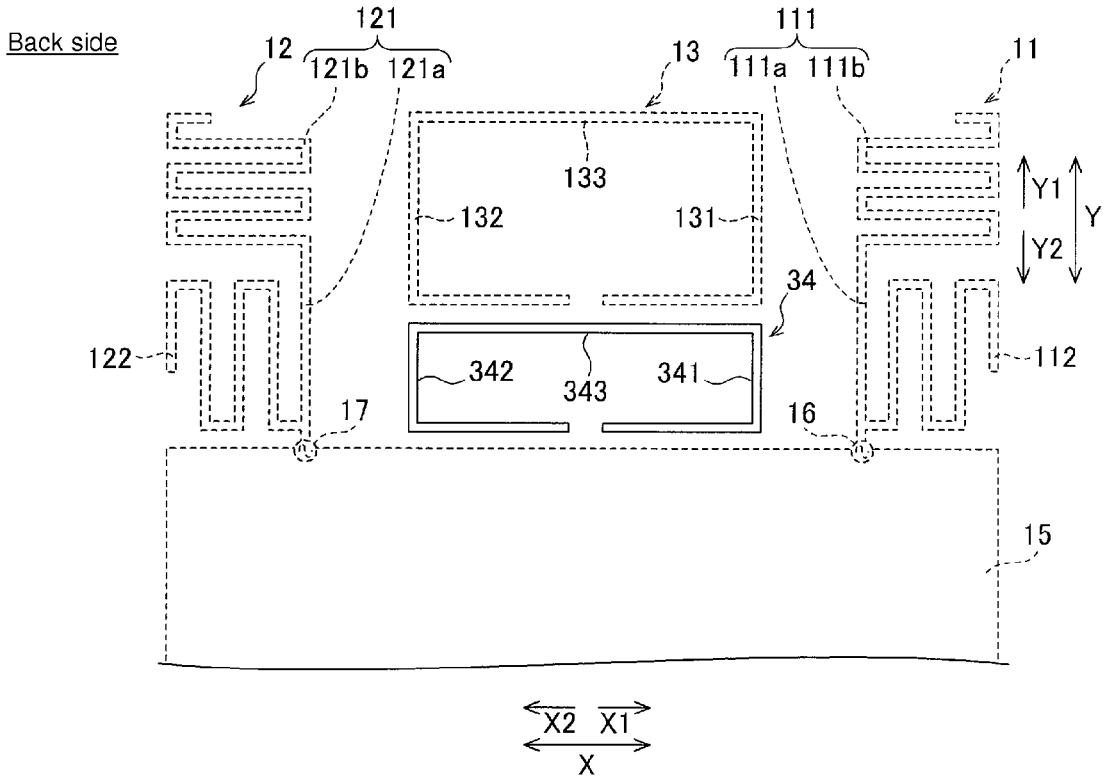
FIG. 10 is a plan view showing the back side of the substrate of the multi-antenna device according to the first modified example of the first and second preferred embodiments of the present invention.

Furthermore, in the first and second preferred embodiments, an example was shown in which the first antenna element, the second antenna element, the first passive element, and the second passive element are all provided on the front-side surface of a substrate (within the same plane), but the present invention is not limited to this. With other modified examples of the preferred embodiments of the present invention, as is shown in FIGS. 9 and 10, for example, it is also possible to provide only a second passive element 34 (the second passive element including a connection portion 343 that connects a first coupling portion 341 and a second coupling portion 342) on the back-side surface of the substrate. That is, the second passive element 34 may be provided on a different surface from the first antenna element 11, the second antenna element 12, and the first passive element 13. In this case, the front-side surface of the substrate is one example of the "first plane" according to a preferred embodiment of the present invention, while the back-side surface of the substrate is one example of the "second plane" according to a preferred embodiment of the present invention. By adopting such a configuration, the first passive element 13 and the second passive element 34 can be disposed so as to be distributed on different surfaces from each other, so it is possible to restrict the space required to install the first passive element 13 and the second passive element 34 to keep it from becoming too large within a single plane. Moreover, because the first passive element 13 and the second passive element 34 can be disposed on mutually different surfaces, the degree of freedom in the arrangement of the equipment internal configuration can be improved. In addition, with the preferred embodiments of the present invention, it is also possible to provide the antenna elements and the passive elements on mutually different surfaces or to provide the first antenna element and the second antenna element on mutually different surfaces. Furthermore, in accordance with preferred embodiments of the present invention, a configuration is also possible in which the antenna elements and the passive elements are provided on mutually separate substrates.

Figure 11:
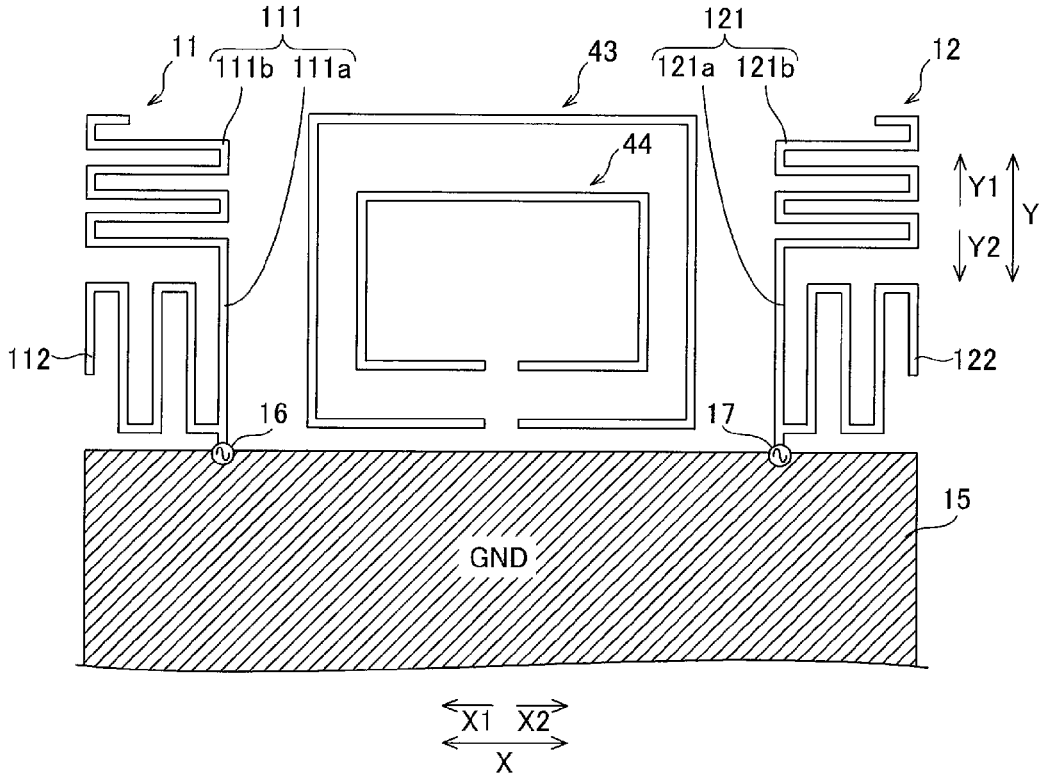
FIG. 11 is a plan view showing the multi-antenna device according to a second modified example of the first and second preferred embodiments of the present invention.

Moreover, with the first and second preferred embodiments, an example was shown in which the first passive element is disposed between the respective main unit portions of the first antenna element and second antenna element in an area corresponding to the main unit portions, and the second passive element is disposed between the respective second frequency band corresponding units of the first antenna element and second antenna element in an area corresponding to the second frequency band corresponding units, but the preferred embodiments of the present invention are not limited to this. With the preferred embodiments of the present invention, it is also possible to dispose the second passive element between the respective main unit portions of the first antenna element and second antenna element in an area corresponding to the main unit portions and to dispose the first passive element between the respective second frequency band corresponding units of the first antenna element and second antenna element in an area corresponding to the second frequency band corresponding units. In addition, with preferred embodiments of the present invention, as shown in FIG. 11, it is also possible to dispose a second passive element 44 inside a first passive element 43 or to dispose the first passive element inside the second passive element. In that case, the passive element disposed on the outside has a portion that faces the first antenna element and a portion that faces the second antenna element.

Furthermore, in the first and second preferred embodiments, an example was shown in which the main unit portions of the first frequency band corresponding units and the second frequency band corresponding units are disposed so as to be respectively adjacent to each other in the Y direction, and the first passive element and the second passive element are disposed so as to be adjacent to each other in the Y direction, but the present invention is not limited to this. With the present invention, it is also possible to dispose the main unit portions of the first frequency band corresponding units and the second frequency band corresponding units so as to be respectively adjacent to each other in the X direction and to dispose the first passive element and the second passive element so as to be adjacent to each other in the X direction.

Moreover, in the first and second preferred embodiments, an example was shown in which the multi-antenna device is configured so as to be compatible with two different frequency bands: the 1.5 GHz band and the 2.0 GHz band, but the present invention is not limited to this. With the preferred embodiments of present invention, the multi-antenna device may also be configured so as to be compatible with two frequency bands other than the 1.5 GHz band and the 2.0 GHz band. In addition, with preferred embodiments of the present invention, the multi-antenna device may also be configured so as to be compatible with three or more frequency bands.

Figure 12:
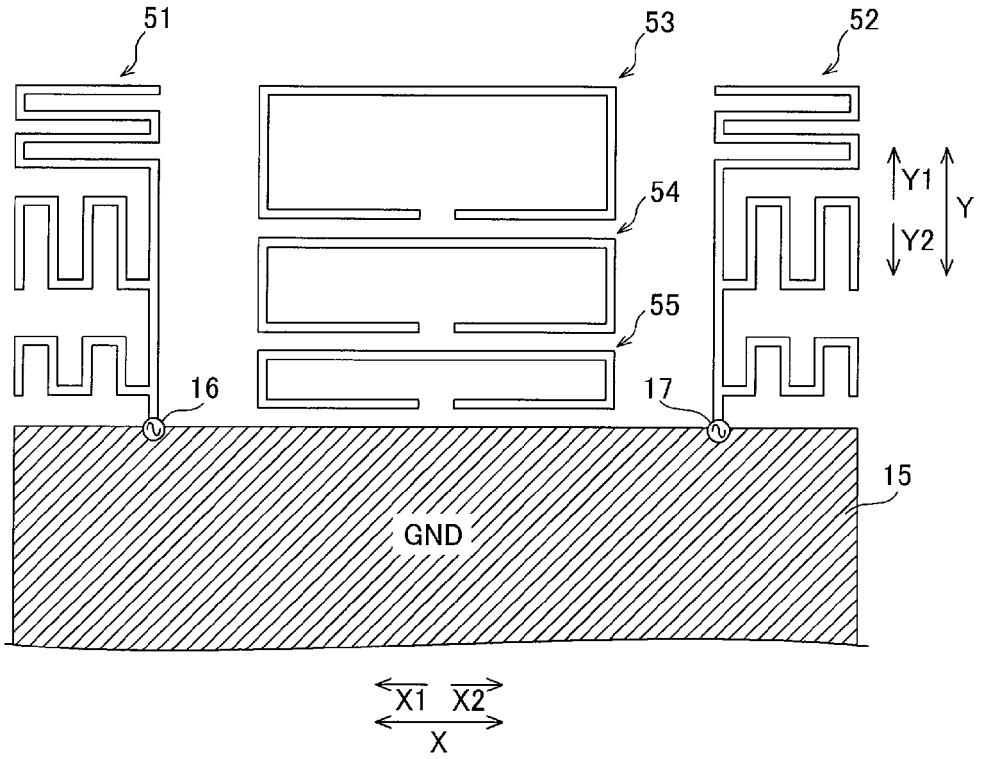
FIG. 12 is a plan view showing the multi-antenna device according to a third modified example of the first and second preferred embodiments of the present invention.

For example, in cases where the multi-antenna device of a preferred embodiment of the present invention is configured so as to be compatible with three frequency bands: a first frequency band, a second frequency band, and a third frequency band, as is shown in FIG. 12, a first passive element 53 which resonates at the frequency corresponding to the first frequency band, a second passive element 54 which resonates at the frequency corresponding to the second frequency band, and a third passive element 55 which resonates at the frequency corresponding to the third frequency band are provided separately from each other between a first antenna element 51 and a second antenna element 52. Furthermore, the first passive element 53, the second passive element 54, and the third passive element 55 all preferably include a portion that faces the first antenna element and a portion that faces the second antenna element. If such a configuration is adopted, it is possible to obtain a multi-antenna device compatible with a triple band which can be miniaturized by reducing the distance between the antenna elements.

Moreover, in the first and second preferred embodiments, a first antenna element (second antenna element) defined by a monopole antenna was shown as one example of the first antenna element (second antenna element), but the present invention is not limited to this. With preferred embodiments of the present invention, a first antenna element (second antenna element) other than a monopole antenna, such as a dipole antenna, may also be used.

Figure 13:
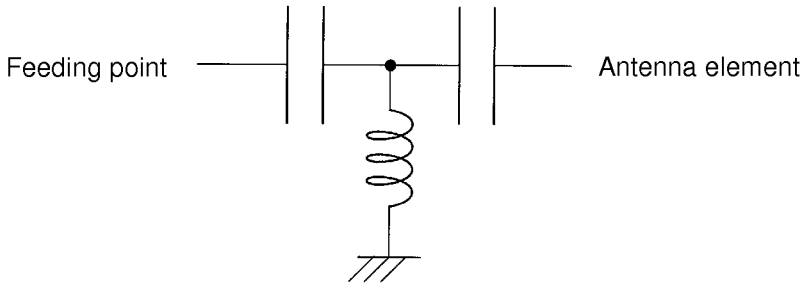
FIG. 13 is a schematic diagram of a T-type matching circuit used in a modified example of the second preferred embodiment of the present invention.
Figure 14:
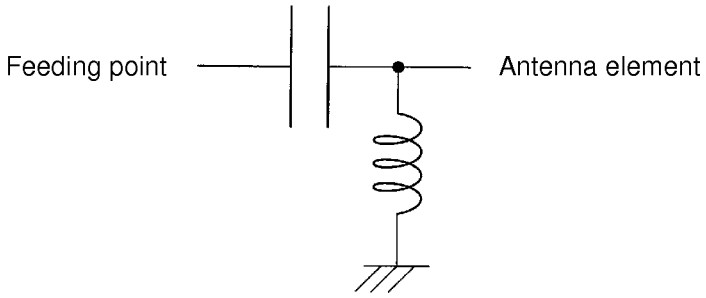
FIG. 14 is a schematic diagram of an L-type matching circuit used in a modified example of the second preferred embodiment of the present invention.

In addition, in the second preferred embodiment, π-type matching circuits (π match) were shown as one example of the matching circuits for use with preferred embodiments of the present invention, but the present invention is not limited to this. With preferred embodiments of the present invention, for instance, in order to achieve impedance matching, it is also possible to provide T-type matching circuits (T match) (see FIG. 13) or to provide L-type matching circuits (L match) (see FIG. 14). Furthermore, each of the π-type matching circuits, T-type matching circuits, and L-type matching circuits may be configured from only either one of an inductor and a capacitor or may also be configured from both an inductor and a capacitor.

Moreover, in the first and second preferred embodiments, an example was shown in which the first antenna element, the second antenna element, the first passive element, and the second passive element are all arranged in a bent shape, but the present invention is not limited to this. With preferred embodiments of the present invention, the first antenna element, the second antenna element, the first passive element, and the second passive element may also be arranged in a curved shape or may also be formed in a combination of bent and curved shapes.

In addition, in the first and second preferred embodiments, an example was shown in which the first passive element and the second passive element preferably are both arranged so as to be ungrounded, but the present invention is not limited to this. With preferred embodiments of the present invention, it is also possible to provide either one of the first passive element and the second passive element so as to be ungrounded and to form the other so as to be grounded.

Figure 15:
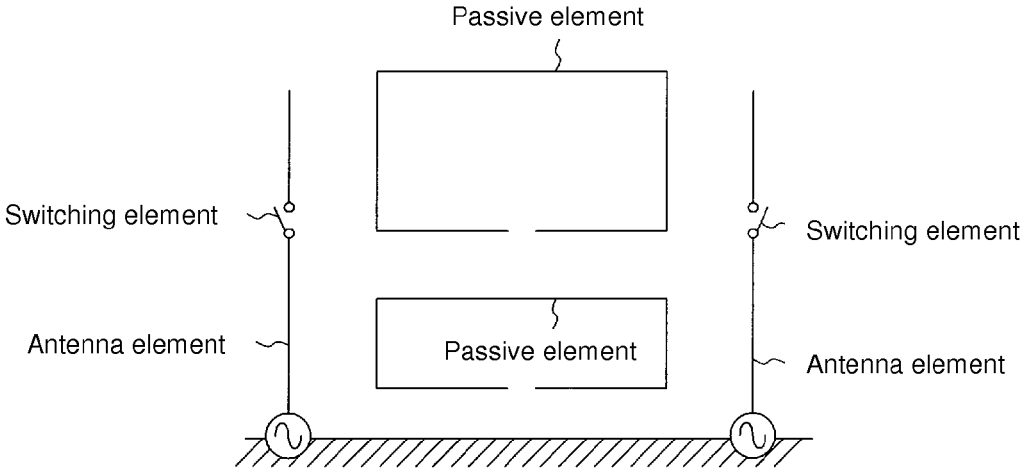
FIG. 15 is a plan view showing the multi-antenna device according to a fourth modified example of the first and second preferred embodiments of the present invention.
Figure 16:
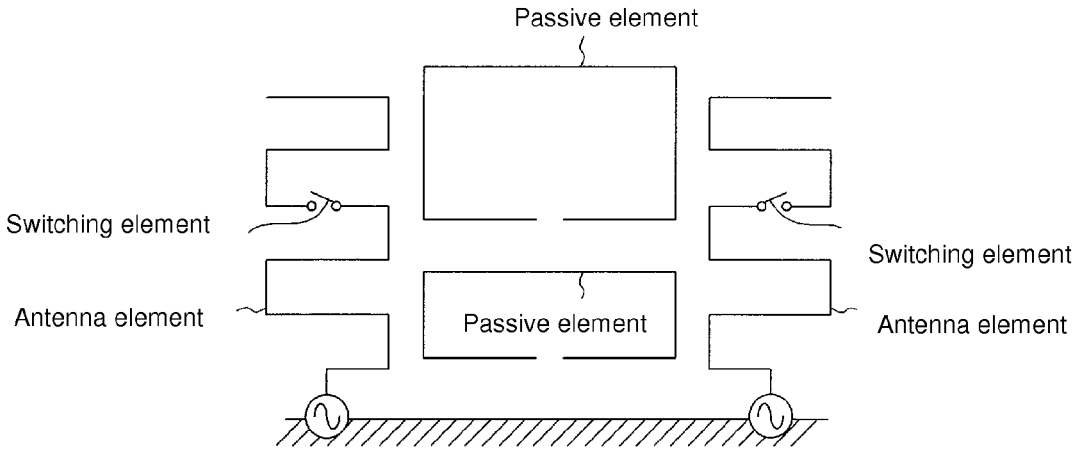
FIG. 16 is a plan view showing the multi-antenna device according to a fifth modified example of the first and second preferred embodiments of the present invention.

Furthermore, in the aforementioned first and second preferred embodiments, an example was shown in which the first frequency band corresponding unit and second frequency band corresponding unit of each antenna element are formed integrally with each other, but the present invention is not limited to this. With preferred embodiments of the present invention, as is shown in FIGS. 15 and 16, a configuration is also possible in which the full length of each antenna element is switchable by providing a switching element in each antenna element, thus making the multi-antenna device compatible with the first frequency band and the second frequency band. Furthermore, in all of the passive elements of FIGS. 15 and 16, a portion on the side of one antenna element (the other antenna element) is disposed so as to face this one antenna element (the other antenna element).

Third Preferred Embodiment

First, the configuration of the mobile phone 100 according to a third preferred embodiment of the present invention will be described with reference to FIGS. 1 and 17. Note that in the third preferred embodiment, an example will be described in which the multi-antenna device 10 of the present invention is applied to the mobile phone 100 which is used as the communication equipment.

As is shown in FIG. 1, the mobile phone 100 according to the third preferred embodiment of the present invention includes a display screen portion 1 and operating portions 2. Furthermore, a communication portion 3 and a multi-band compatible multi-antenna device 10 are provided inside the housing of the mobile phone 100.

The display screen portion 1 is preferably provided by a liquid crystal display and configured so as to be able to display images. The operating portions 2 are preferably provided by, for example, a plurality of buttons, touch panels, etc. and are configured so as to be able to receive user operations. The communication portion 3 is configured so as to perform communication using the electric waves sent and received by the multi-antenna device 10.

The multi-antenna device 10 is preferably configured for MIMO (Multiple-Input Multiple-Output) communication in which multiple input/output is possible at specified frequencies by using a plurality of antenna elements. Moreover, the multi-antenna device 10 is compatible with two different bands (frequency bands): the 1.5 GHz band and the 2.0 GHz band. Note that the 1.5 GHz band is one example of the "first frequency band" of a preferred embodiment of the present invention, and the 2.0 GHz band is one example of the "second frequency band" of a preferred embodiment of the present invention.

Figure 17:
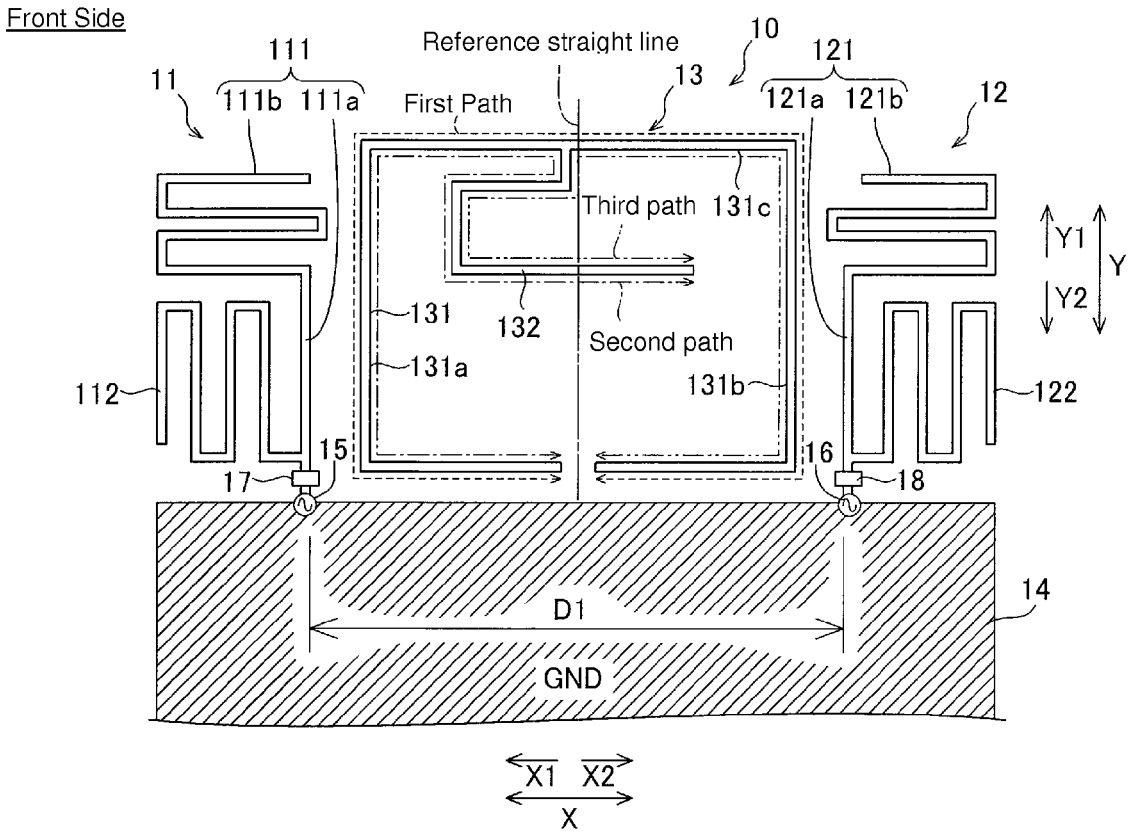
FIG. 17 is a plan view showing the front side of the substrate of the multi-antenna device of the mobile phone according to the third preferred embodiment of the present invention.

As is shown in FIG. 17, the multi-antenna device 10 preferably includes a first antenna element 11, a second antenna element 12, a single passive element 13 disposed between the two antenna elements 11 and 12, and a ground surface 14. The multi-antenna device 10 preferably further includes a first feeding point 15 arranged to supply high-frequency power to the first antenna element 11 and a second feeding point 16 arranged to supply high-frequency power to the second antenna element 12, as well as a first matching circuit 17 and a second matching circuit 18 arranged to achieve impedance matching. Note that the first feeding point 15 and the second feeding point 16 are examples of the "feeding points" of a preferred embodiment of the present invention, and the first matching circuit 17 and the second matching circuit 18 are examples of the "matching circuits" of a preferred embodiment of the present invention.

The first antenna element 11 is disposed at the X1 direction side of the passive element 13, and the second antenna element 12 is disposed at the X2 direction side of the passive element 13. Furthermore, the first antenna element 11 and the second antenna element 12 are preferably both provided on the front-side surface of a substrate, which is not illustrated. Moreover, the first antenna element 11 and the second antenna element 12 are preferably provided in a substantially line symmetrical shape with respect to each other and to a reference straight line which is perpendicular or substantially perpendicular to the straight line connecting the first feeding point 15 and the second feeding point 16 and which passes through the midpoint between the first feeding point 15 and the second feeding point 16. In addition, the first antenna element 11 (second antenna element 12) preferably has a thin plate shape. Furthermore, the first antenna element 11 (second antenna element 12) is preferably a monopole antenna. In concrete terms, the first antenna element 11 (second antenna element 12) includes a first frequency band corresponding unit 111 (121) having an electrical length equal or approximately equal to ¼ of the 1.5 GHz wavelength λ1 and a second frequency band corresponding unit 112 (122) having an electrical length equal or approximately equal to ¼ of the 2.0 GHz wavelength λ2, with the multi-antenna device 10 being compatible with both of these bands. Note that the 1.5 GHz wavelength in a vacuum is 200 mm, and the 2.0 GHz wavelength in a vacuum is 150 mm. Moreover, the electrical length is a length that has 1 wavelength of the signal that progresses on the conductor constituting the antenna as a standard, rather than 1 wavelength in a vacuum. The first frequency band corresponding unit 111 (121) and the second frequency band corresponding unit 112 (122) both have one end portion open, and the other end portion grounded to the ground surface 14 via the first feeding point 15 (second feeding point 16). In addition, the first frequency band corresponding unit 111 (121) and the second frequency band corresponding unit 112 (122) are preferably integral with each other so as to define a single monolithic member.

The first frequency band corresponding unit 111 (121) includes a power supply connection portion 111*a* (121*a*) connected to the first feeding point 15 (second feeding point 16) and a main unit portion 111*b* (121*b*) linked to the power supply connection portion 111*a* (121*a*). The power supply connection portion 111*a* (121*a*) of the first frequency band corresponding unit 111 (121) preferably is provided in a rectilinear shape so as to extend in the Y1 direction from the first feeding point 15 (second feeding point 16). That is, the power supply connection portion 111*a* of the first antenna element 11 and the power supply connection portion 121*a* of the second antenna element 12 are disposed in parallel or substantially in parallel to each other.

The main unit portion 111*b* (121*b*) is linked to the end portion of the power supply connection portion 111*a* (121*a*) on the side (at the Y1 direction side) opposite from the side on which the first feeding point 15 (second feeding point 16) is provided. Furthermore, the main unit portion 111*b* (121*b*) is disposed on the side (at the Y1 direction side) of the second frequency band corresponding unit 112 (122) opposite from the side on which the first feeding point 15 (second feeding point 16) is disposed (at the Y2 direction side). Moreover, the main unit portion 111*b* (121*b*) is configured so as to extend in the Y1 direction while being folded at a plurality of positions in the X direction (in the direction in which the first antenna element 11 and the second antenna element 12 face each other). That is, the main unit portion 111*b* (121*b*) is shaped so as to be bent at a plurality of positions. In addition, the configuration is such that the full length of the main unit portion 111*b* (121*b*) is longer than the full length of the power supply connection portion 111*a* (121*a*).

The second frequency band corresponding unit 112 (122) is configured so as to extend to the outside (to the side opposite from the side on which the passive element 13 is disposed) while being folded at a plurality of positions in the Y direction (in the direction orthogonal to the direction in which the first antenna element 11 and the second antenna element 12 face each other). That is, the second frequency band corresponding unit 112 (122) is shaped so as to be bent at a plurality of positions. Furthermore, the second frequency band corresponding unit 112 (122) is disposed on the outside of the power supply connection portion 111*a* (121*a*) of the first frequency band corresponding unit 111 (121). Moreover, the second frequency band corresponding unit 112 (122) is disposed so as to be adjacent to the main unit portion 111*b* (121*b*) of the first frequency band corresponding unit 111 (121) at the Y2 direction side of the main unit portion 111*b* (121*b*). In addition, the second frequency band corresponding unit 112 (122) is disposed in an area enclosed by the power supply connection portion 111*a* (121*a*) and main unit portion 111*b* (121*b*) of the first frequency band corresponding unit 111 (121). Furthermore, the outer end portion of the second frequency band corresponding unit 112 (122) is preferably disposed so as to be flush with the outer end portion of the main unit portion 111*b* (121*b*) of the first frequency band corresponding unit 111 (121).

The passive element 13 is preferably disposed in an area in which the first antenna element 11 and the second antenna element 12 face each other. Moreover, the passive element 13 is preferably provided in an ungrounded state, such that the passive element 13 is not grounded to the ground surface 14. In addition, the passive element 13 is preferably configured so as to resonate at both the frequency corresponding to the 1.5 GHz band (frequency near 1.5 GHz) and the frequency corresponding to the 2.0 GHz band (frequency near 2.0 GHz). Furthermore, the passive element 13 is shaped so as to be bent at a plurality of positions. Moreover, the passive element 13 preferably includes a main unit portion 131 and a branch portion 132 that branches from the main unit portion 131.

The main unit portion 131 is preferably arranged substantially in the shape of the letter C as seen in plan view. To further describe this feature, as is shown in FIG. 17, the main unit portion 131 includes, on the front side of the substrate, a first coupling portion 131*a* that is disposed at a distance which allows coupling with the first antenna element 11, a second coupling portion 131*b* that is disposed at a distance which allows coupling with the second antenna element 12, and a connection portion 131*c* that connects the first coupling portion 131*a* and the second coupling portion 131*b* to each other. The first coupling portion 131*a*, the second coupling portion 131*b*, and the connection portion 131*c* are all provided on the front-side surface of the substrate. Note that in the third preferred embodiment, coupling refers to the concept of electromagnetic coupling that includes both capacitive coupling and magnetic coupling.

The first coupling portion 131*a* and the second coupling portion 131*b* are both preferably provided substantially in the shape of the letter L by the portion extending in the Y direction and the portion extending in the X direction from the Y2 direction-side end portion of the portion extending in the Y direction. In addition, the first coupling portion 131*a* (second coupling portion 131*b*) is preferably disposed such that the portion extending in the Y direction faces the main unit portion 111*b* of the first antenna element 11 (main unit portion 121*b* of the second antenna element 12). Furthermore, the first coupling portion 131*a* (second coupling portion 131*b*) is preferably disposed such that the portion extending in the Y direction also faces the power supply connection portion 111*a* of the first antenna element 11 (power supply connection portion 121*a* of the second antenna element 12).

The connection portion 131*c* is preferably configured so as to connect the Y1 direction-side end portion of the first coupling portion 131*a* and the Y1 direction-side end portion of the second coupling portion 131*b*. Moreover, the connection portion 131*c* is preferably arranged so as to extend in a rectilinear manner from one side to the other side between the first antenna element 11 and the second antenna element 12 (so as to extend in the X direction).

With such a configuration, the main unit portion 131 defines a first path which extends from the X2 direction-side end portion (tip end portion) of the portion extending in the X direction of the first coupling portion 131*a*, passes through the connection portion 131*c*, and reaches the X1 direction-side end portion (tip end portion) of the portion extending in the X direction of the second coupling portion 131*b*. The first path preferably has an electrical length equal or approximately equal to ½ of the 1.5 GHz wavelength λ1 to which the first frequency band corresponding unit 111 (121) corresponds. Consequently, the passive element 13 is preferably resonated at the frequency corresponding to the 1.5 GHz band (frequency near 1.5 GHz). In addition, the main unit portion 131 preferably is provided in a line symmetrical shape with respect to the aforementioned reference straight line.

The branch portion 132 of the passive element 13 preferably branches from a position at or substantially at ½ of the full length of the main unit portion 131. Specifically, the branch portion 132 is disposed on the front-side surface of the substrate and branches from substantially the central position of the connection portion 131*c* of the main unit portion 131. Furthermore, the branch portion 132 is disposed within an area enclosed by the main unit portion 131. Moreover, the branch portion 132 is preferably shaped so as to be bent at a plurality of positions. In addition, the branch portion 132 is preferably provided in an asymmetrical shape with respect to the aforementioned reference straight line.

Furthermore, the branch portion 132 and the main unit portion 131 define a second path which extends from the X2 direction-side end portion (tip end portion) of the portion extending in the X direction of the first coupling portion 131*a*, passes through the connection portion 131*c*, and reaches the tip end portion of the branch portion 132. Moreover, the branch portion 132 and the main unit portion 131 define a third path which extends from the X1 direction-side end portion (tip end portion) of the portion that extends in the X direction of the second coupling portion 131*b*, passes through the connection portion 131*c*, and reaches the tip end portion of the branch portion 132. That is, the second path is defined by the branch portion 132 and a portion of the main unit portion 131 on the side of the first antenna element 11, while the third path is defined by the branch portion 132 and a portion of the main unit portion 131 on the side of the second antenna element 12. In addition, the second path and the third path both have an electrical length equal or approximately equal to ½ of the 2.0 GHz wavelength λ2 to which the second frequency band corresponding unit 112 (122) corresponds. Consequently, the passive element 13 is preferably resonated at the frequency corresponding to the 2.0 GHz band (frequency near 2.0 GHz).

The first feeding point 15 (second feeding point 16) is disposed at the Y2 direction-side end portion of the first antenna element 11 (second antenna element 12). Furthermore, the first feeding point 15 (second feeding point 16) connects the first antenna element 11 (second antenna element 12) and the feeder line, which is not illustrated.

Figure 19:
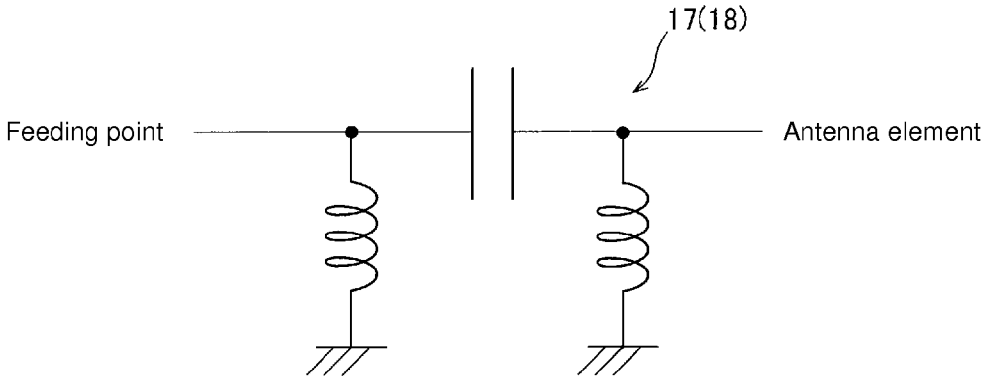
FIG. 19 is a schematic diagram showing a π-type matching circuit used in the multi-antenna device of the mobile phone according to the third preferred embodiment of the present invention.

The first matching circuit 17 (second matching circuit 18) is preferably disposed between the first antenna element 11 (second antenna element 12) and the first feeding point 15 (second feeding point 16). Moreover, the first matching circuit 17 (second matching circuit 18) is preferably configured so as to achieve impedance matching at 1.5 GHz and 2.0 GHz with which the multi-antenna device 10 is compatible. In concrete terms, as is shown in FIG. 19, the first matching circuit 17 (second matching circuit 18) is configured by a π-type matching circuit (π match) configured from an inductor (i.e., a coil) and a capacitor.

In the third preferred embodiment, as was described above, as a result of the single passive element 13 which resonates at both the frequency corresponding to the 1.5 GHz band and the frequency corresponding to the 2.0 GHz band being provided between the first antenna element 11 and the second antenna element 12, it is possible to reduce the amount of interconnection between the antenna elements. In addition, because the amount of interconnection between the first antenna element 11 and the second antenna element 12 can be reduced, the distance between the antenna elements can be reduced correspondingly and, as a result, it is possible to miniaturize the multi-band compatible multi-antenna device 10. Consequently, it is also possible to miniaturize a mobile phone 100 including such a multi-band compatible multi-antenna device 10. Accordingly, this mobile phone 100 can be miniaturized by reducing the distance between the antenna elements. Preferred embodiments of the present invention are particularly more effective with communication equipment in relation to which there is a demand for miniaturization such as the mobile phone 100 of the third preferred embodiment. Note that the effect of being able to reduce the amount of interconnection between antenna elements via the aforementioned configuration has been confirmed through simulation which will be described later.

Furthermore, by adopting the configuration such that the single passive element 13 resonates at both the frequency corresponding to the 1.5 GHz band and the frequency corresponding to the 2.0 GHz band, it is possible to prevent the passive element installation space from becoming overly large, as compared to when a passive element that resonates at the frequency corresponding to the 1.5 GHz band and a passive element that resonates at the frequency corresponding to the 2.0 GHz band are provided separately from each other. Moreover, by configuring the first antenna element 11 and the second antenna element 12 so as to both correspond to 1.5 GHz and 2.0 GHz, the first antenna element 11 (second antenna element 12) is used for both 1.5 GHz and 2.0 GHz, so it is possible to install the antenna elements in a smaller space as compared to the when providing a different antenna element for each frequency band. On the basis of this, it is possible to further miniaturize the multi-antenna device 10.

In addition, in the third preferred embodiment, as was described above, the passive element 13 is provided so as to be ungrounded. With such a configuration, because it is not necessary to ground the passive element 13 to the ground surface 14, it is possible to prevent the decrease in the degree of freedom in wiring pattern design.

Furthermore, in the third preferred embodiment, as was described above, the ungrounded passive element 13 is configured so as to define the first path having an electrical length equal or substantially equal to ½ of the wavelength λ1 of the electric wave that is output corresponding to the 1.5 GHz band by the first antenna element 11 and the second antenna element 12 and the second path having an electrical length equal or substantially equal to ½ of the wavelength λ2 of the electric wave that is output corresponding to the 2.0 GHz band by the first antenna element 11 and the second antenna element 12. By adopting such a configuration, it is possible to easily have the single ungrounded passive element 13 resonate at both the frequency corresponding to the 1.5 GHz band and the frequency corresponding to the 2.0 GHz band.

Moreover, in the third preferred embodiment, as was described above, the first path is defined by the main unit portion 131, and the second path is defined by a portion of the main unit portion 131 and the branch portion 132. With such a configuration, the main unit portion 131 of the passive element 13 is used for both the first path and the second path, so the passive element 13 can be miniaturized, compared to the case of forming the first path and the second path respectively from separate portions and, as a result, it is possible to achieve further miniaturization of the multi-antenna device 10.

In addition, in the third preferred embodiment, as was described above, the passive element 13 is arranged to define the first path which is defined by the main unit portion 131 and which has an electrical length of equal or substantially equal to ½ of the wavelength λ1, the second path which is defined by the branch portion 132 and a portion of the main unit portion 131 on the side of the first antenna element 11 (the first coupling portion 131*a* and the connection portion 131*c*) and which has an electrical length equal or substantially equal to ½ of the wavelength λ2, and the third path which is configured from the branch portion 132 and a portion of the main unit portion 131 on the side of the second antenna element 12 (the second coupling portion 131*b* and the connection portion 131*c*) and which has an electrical length equal or substantially equal to ½ of the wavelength λ2 that is the same or substantially the same as in the second path. By adopting such a configuration, the first path can easily cause the passive element 13 to resonate at the frequency corresponding to the 1.5 GHz band, and the second path on the side of the first antenna element 11 and the third path on the side of the second antenna element 12 can respectively cause the passive element 13 to effectively resonate with the electric waves output from the first antenna element 11 and the second antenna element 12.

Furthermore, in the third preferred embodiment, as was described above, the first antenna element 11 and the second antenna element 12 are preferably provided in a substantially line symmetrical shape with respect to each other and to the reference straight line which is perpendicular or substantially perpendicular to the straight line that connects the first feeding point 15 and the second feeding point 16 and which passes through the midpoint between the feeding points, and the main unit portion 131 of the passive element 13 is preferably provided in a line symmetrical shape with respect to the aforementioned reference straight line. By adopting such a configuration, the antenna elements 11 and 12 and the main unit portion 131 of the passive element 13 are each disposed with good balance, so it is possible to suppress gain variations while reducing the amount of interconnection between the antenna elements.

Moreover, in the third preferred embodiment, as was described above, the branch portion 132 preferably branches from the position at or substantially at ½ of the full length of the main unit portion 131 defined in a line symmetrical shape with respect to the aforementioned reference straight line, and the branch portion 132 is arranged in a bent shape. With such a configuration, the bent shape of the branch portion 132 makes it possible to easily ensure the length required for the branch portion 132, so it is possible to suppress or substantially suppress expansion of the installation space required by the branch portion 132. In addition, as compared to a case in which the branch portion 132 is arranged in a rectilinear manner, adjustments can be made easily so as to match the position of the resonance point of the passive element 13 to a desired frequency.

Furthermore, in the third preferred embodiment, as was described above, the first antenna element 11, the second antenna element 12, and the passive element 13 are all shaped so as to be bent at a plurality of positions. By adopting such a configuration, the bent shapes of the antenna elements 11 and 12 and passive element 13 make it possible to easily ensure the lengths respectively required for the antenna elements 11 and 12 and the passive element 13, so it is possible to prevent the expansion of the installation space for the antenna elements 11 and 12 and the passive element 13 and, as a result, it is possible to miniaturize the multi-antenna device 10.

Moreover, in the third preferred embodiment, as was described above, the first matching circuit 17 arranged to achieve impedance matching at 1.5 GHz and 2.0 GHz is provided between the first antenna element 11 and the first feeding point 15, and the second matching circuit 18 arranged to achieve impedance matching at 1.5 GHz and 2.0 GHz is provided between the second antenna element 12 and the second feeding point 16. With such a configuration, impedance matching can be achieved at 1.5 GHz and 2.0 GHz by the first matching circuit 17 (second matching circuit 18), so it is possible to reduce the transmission loss of the energy transmitted via the antenna elements while achieving the miniaturization of the multi-antenna device 10.

In addition, in the third preferred embodiment, as a result of the first frequency band corresponding unit 111 (121) and the second frequency band corresponding unit 112 (122) being preferably integrally provided with each other as a single monolithic member, unlike a configuration in which a switching element is used to switch the full length of each antenna element and thus to handle the first frequency band and the second frequency band, there is no need to provide a dedicated switching control device to control the switching element, so it is possible to prevent the circuit configuration from becoming complex and, as a result, it is possible to miniaturize the space required for the antennas.

Note that in the third preferred embodiment, a configuration was shown in which the first antenna element 11, the second antenna element 12, and the passive element 13 are all preferably provided on the front-side surface of the substrate, but the present invention is not limited to this. With preferred embodiments of the present invention, for example, the passive element 13 may also be disposed so as to span across from the front-side surface to the back-side surface of the substrate. Next, this configuration will be described.

Figure 18:
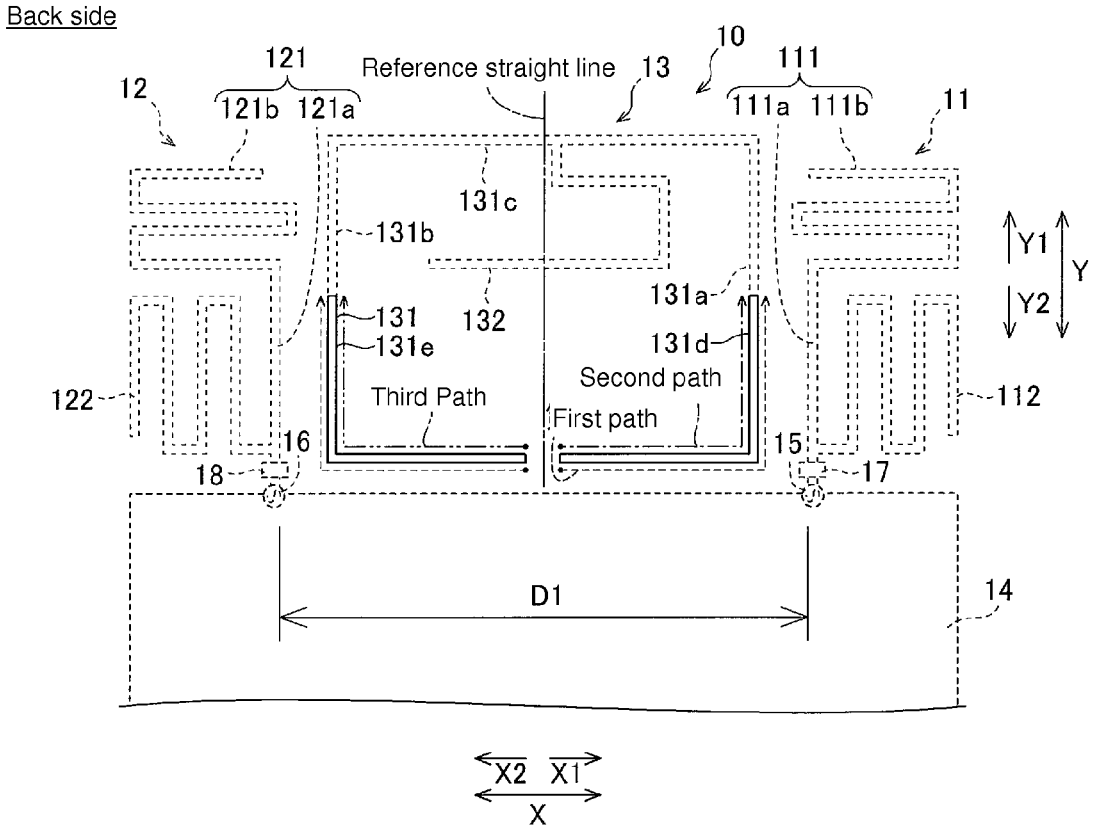
FIG. 18 is a plan view showing the back side of the substrate of the multi-antenna device for describing a modified example of the third preferred embodiment of the present invention.

As is shown in FIG. 18, on the back side of the substrate, the main unit portion 131 preferably includes a first back-side portion 131*d* disposed so as to overlap with the first coupling portion 131*a* as seen in plan view and a second back-side portion 131*e* disposed so as to overlap with the second coupling portion 131*b* as seen in plan view. The first back-side portion 131*d* and the second back-side portion 131*e* are both preferably provided on the back-side surface of the substrate. That is, the main unit portion 131 is provided so as to span across the front-side surface and the back-side surface of the substrate.

The first back-side portion 131*d* (second back-side portion 131*e*) is connected to the X2 direction side (X1 direction side) end portion of the portion extending in the X direction of the first coupling portion 131*a* (second coupling portion 131*b*). Furthermore, the first back-side portion 131*d* (second back-side portion 131*e*) is preferably arranged substantially in the shape of the letter L so as to overlap with the first coupling portion 131*a* (second coupling portion 131*b*) as seen in plan view. In concrete terms, the first back-side portion 131*d* (second back-side portion 131*e*) is preferably arranged substantially in the shape of the letter L from the portion extending in the Y direction and the portion extending in the X direction from the Y2 direction-side end portion of the portion extending in the Y direction.

Then, with this configuration, the path which extends from the Y1 direction-side tip end portion of the first back-side portion 131*d*, passes through in sequence the first coupling portion 131*a*, the connection portion 131*c*, and the second coupling portion 131*b*, and reaches the Y1 direction-side tip end portion of the second back-side portion 131*e* defines the first path. The first path preferably includes an electrical length equal or approximately equal to 1.5 GHz wavelength λ1 to which the first frequency band corresponding unit 111 (121) corresponds.

Moreover, the path which extends from the Y1 direction-side tip end portion of the first back-side portion 131*d*, passes through in sequence the first coupling portion 131*a* and the connection portion 131*c*, and reaches the tip end portion of the branch portion 132 defines the second path. In addition, the path which extends from the Y1 direction-side tip end portion of the second back-side portion 131*e*, passes through in sequence the second coupling portion 131*b* and the connection portion 131*c*, and reaches the tip end portion of the branch portion 132 defines the third path. That is, the second path is provided the branch portion 132 and a portion of the main unit portion 131 on the side of the first antenna element 11, and the third path is provided by the branch portion 132 and a portion of the main unit portion 131 on the side of the second antenna element 12. Furthermore, the second path and the third path both have an electrical length equal or approximately equal to ½ of the 2.0 GHz wavelength λ2 to which the second frequency band corresponding unit 112 (122) corresponds.

Thus, as a result of the passive element 13 being disposed so as to span across the front-side surface and the back-side surface of the substrate, the passive element 13 can be disposed so as to overlap on different surfaces as seen in plan view. Therefore, it is possible to dispose the passive element 13 in a smaller space as seen in plan view. Moreover, because the passive element 13 can be disposed on different surfaces, it is possible to improve the degree of freedom in the arrangement of the equipment internal configuration.

Next, the results of a simulation that was performed in order to confirm the effects of the third preferred embodiment will be described. With this simulation, a comparison was made between the multi-band compatible multi-antenna device 10 corresponding to the third preferred embodiment shown in FIG. 17 and the multi-antenna device 110 according to a comparative example shown in FIG. 20.

With the multi-antenna device 10 corresponding to the third preferred embodiment, the first antenna element 11 and the second antenna element 12 were disposed such that the separation distance D1 for the feeding points was about 32 mm, for example. In addition, with this simulation, the configuration was such that the first antenna element 11, the second antenna element 12, and the passive element 13 were disposed on a glass epoxy substrate having a thickness of 1 mm, with this substrate being provided in a vacuum. Furthermore, the first antenna element 11, the second antenna element 12, and the passive element 13 were all configured from a conductor with a thickness of slightly more than about 0 mm. Note that the multi-antenna device 10 corresponding to the third preferred embodiment is compatible with both 1.5 GHz and 2.0 GHz as described above.

Figure 20:
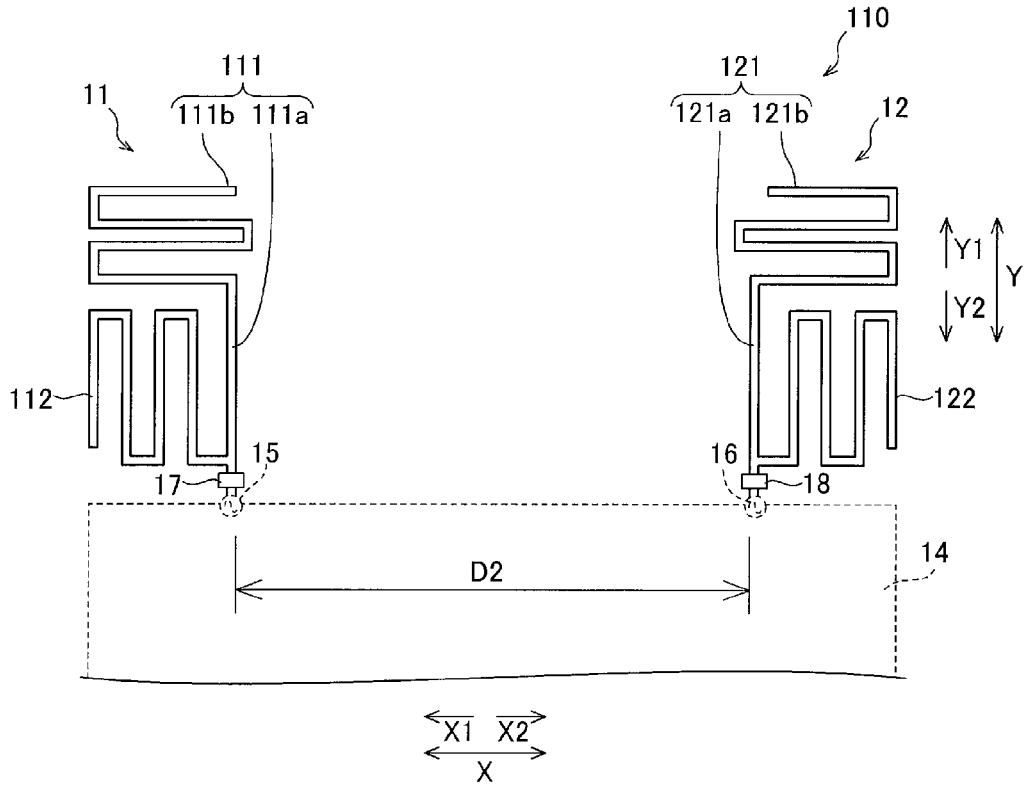
FIG. 20 is a plan view showing the multi-antenna device according to a second comparative example.

As is shown in FIG. 20, with the multi-antenna device 110 according to the comparative example, unlike the multi-antenna device 10 according to the third preferred embodiment in which the ungrounded passive element 13 was provided, a configuration was adopted in which no passive element was provided between the two antenna elements 11 and 12. Moreover, with the multi-antenna device 110 according to the comparative example, the first antenna element 11 and the second antenna element 12 were disposed such that the separation distance D2 for the feeding points was 32 mm as in the multi-antenna device 10 corresponding to the third preferred embodiment. In addition, the remainder of the configuration of the multi-antenna device 110 according to the comparative example is the same as that of the multi-antenna device 10 corresponding to the third preferred embodiment.

Next, referring to FIGS. 21 and 22, a description will be given regarding the S parameter characteristics of the multi-antenna device 110 according to the comparative example and the multi-antenna device 10 corresponding to the third preferred embodiment. Here, of the S parameters shown in FIGS. 21 and 22, S11 (S22) indicates the reflection coefficient of the antenna element, and S21 (S12) of the S parameters indicates the strength of the interconnection between the two antenna elements. Furthermore, in FIGS. 21 and 22, the horizontal axis is the frequency, and the vertical axis is the size (unit: dB) of S11 (S22) and S21 (S12).

Figure 21:
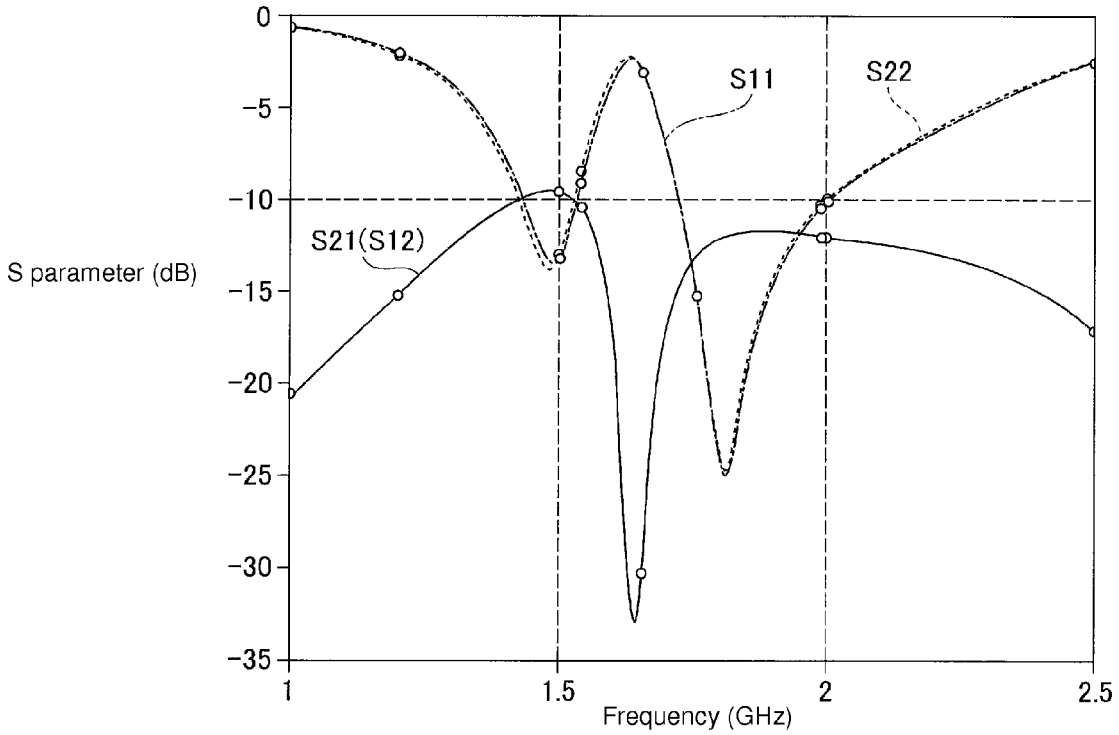
FIG. 21 is a diagram showing the S parameter characteristics with a simulation of the multi-antenna device according to the second comparative example.
Figure 22:
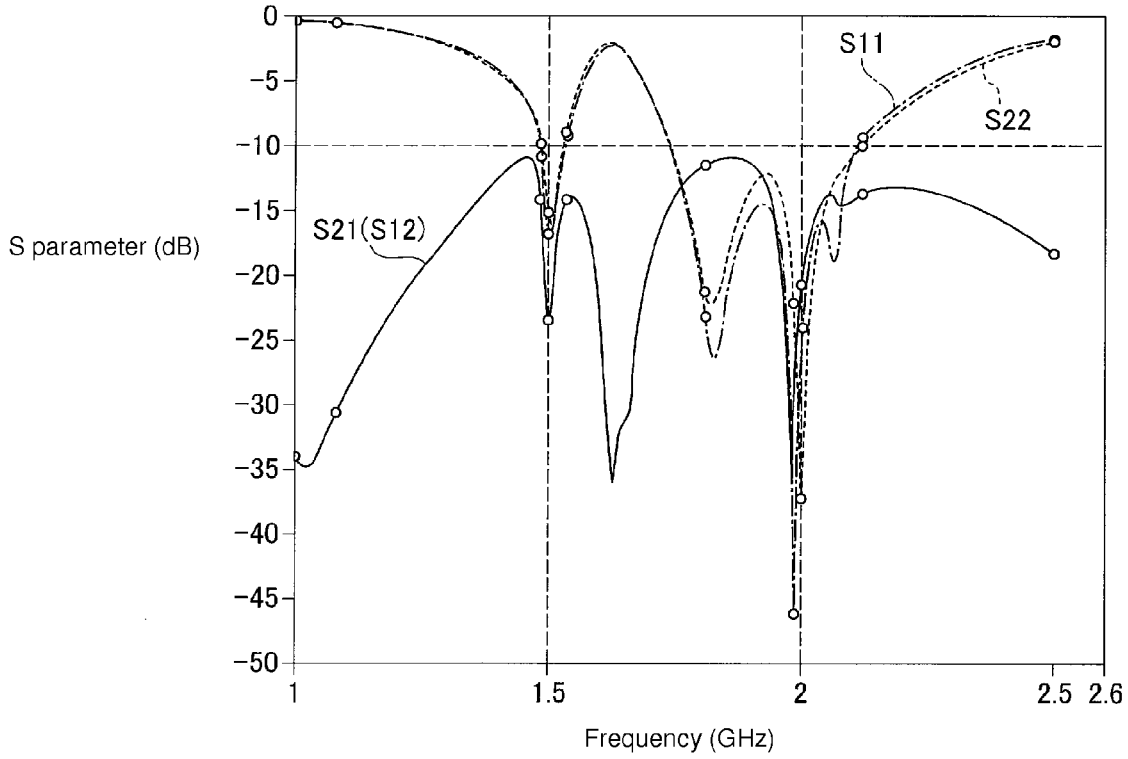
FIG. 22 is a diagram showing the S parameter characteristics with a simulation of the multi-antenna device corresponding to the third preferred embodiment of the present invention.

First, with the multi-antenna device 110 according to the comparative example, at 1.5 GHz, S11 (S22) was approximately −13 dB, while S21 (S12) was approximately −9.5 dB as shown in FIG. 21. Moreover, with the multi-antenna device 110 according to the comparative example, the resonance point near 2.0 GHz was 1.8 GHz, at which S11 (S22) was approximately −25 dB, while S21 (S12) was approximately −12 dB. In contrast, with the multi-antenna device 10 corresponding to the third preferred embodiment, at 1.5 GHz, S11 (S22) was approximately −16 dB, while S21 (S12) was approximately −24 dB as shown in FIG. 22. In addition, with the multi-antenna device 10 corresponding to the third preferred embodiment, at 2.0 GHz, S11 (S22) was approximately −25 dB or less, and S21 (S12) was approximately −21 dB. Note that the shift in the resonance point between the multi-antenna device 110 according to the comparative example and the multi-antenna device 10 corresponding to the third preferred embodiment is thought to occur due to the presence or absence of electromagnetic coupling between the passive element and the antenna elements. Furthermore, for both the multi-antenna device 110 according to the comparative example and the multi-antenna device 10 corresponding to the third preferred embodiment, the slight shift between S11 and S22 which indicate the reflection coefficients of the antenna elements is thought to occur for the following reason: namely, even though the first antenna element 11 and the second antenna element 12 are preferably arranged in a substantially line symmetrical shape with respect to each other and to the reference straight line, there is a slight difference, and this difference is thought to have caused the shift.

As a result, the value of S21 (S12) indicating the strength (size) of the interconnection between the two antenna elements is smaller at both 1.5 GHz and 2.0 GHz with the multi-antenna device 10 corresponding to the third preferred embodiment than with the multi-antenna device 110 according to the comparative example, so it was confirmed that the amount of interconnection between the antenna elements can be reduced by providing the ungrounded passive element 13. Moreover, in contrast to the fact that with the multi-antenna device 110 according to the comparative example, only one portion at which the value of S21 (S12) rapidly drops (valley portion) occurs in the area between 1.5 GHz and 2.0 GHz as shown in FIG. 21, with the multi-antenna device 10 corresponding to the third preferred embodiment, a portion at which the value of S21 (S12) rapidly drops (valley portion) occurs both near 1.5 GHz and near 2.0 GHz as shown in FIG. 22. That is, with the multi-antenna device 10 corresponding to the third preferred embodiment, at 1.5 GHz and 2.0 GHz, the value of S21 (S12) decreases. Note that if the value of S21 (S12) is −10 dB or less, it is thought that the interconnection between the antenna elements is tiny.

As a reason for the decrease in the value of S21 (S12) at 1.5 GHz, with the multi-antenna device 10 corresponding to the third preferred embodiment, it is thought that this is because at the first frequency band corresponding unit 111 (121) of the first antenna element 11 (second antenna element 12), direct coupling caused by current flowing in the other antenna element and indirect coupling caused by current flowing in the passive element 13 including the first path occur, thereby negating or substantially negating the interconnection between the antenna elements. In addition, as a reason for the decrease in the value of S21 (S12) at 2.0 GHz, it is thought that this is because at the second frequency band corresponding unit 112 (122) of the first antenna element 11 (second antenna element 12), direct coupling caused by current flowing in the other antenna element and indirect coupling caused by current flowing in the passive element 13 having the second path (third path) occur, thereby negating or substantially negating the interconnection between the antenna elements.

Fourth Preferred Embodiment

Next, referring to FIG. 23, a description will be given regarding the multi-antenna device 20 of the mobile equipment 200 (see FIG. 1) according to a fourth preferred embodiment of the present invention. In this fourth preferred embodiment, unlike the aforementioned third preferred embodiment in which the main unit portion 131 of the passive element 13 is preferably arranged substantially in the shape of the letter C as seen in plan view, a configuration will be described in which the main unit portion 231 of a passive element 23 is arranged so as to extend in the X direction while being folded in the Y direction. Note that in the fourth preferred embodiment, an example will be described in which the multi-antenna device 20 of the present invention is applied to the mobile phone 200 which is used as the communication equipment.

The multi-band compatible multi-antenna device 20 of the mobile equipment 200 (see FIG. 1) according to the fourth preferred embodiment of the present invention is preferably configured to be compatible with MIMO communication in which multiple input/output is possible at specified frequencies by using a plurality of antenna elements. Furthermore, the multi-antenna device 20 is compatible with two different bands (frequency bands): the 1.5 GHz band and the 2.0 GHz band. Note that the 1.5 GHz band is one example of the "first frequency band" according to a preferred embodiment of the present invention, and the 2.0 GHz band is one example of the "second frequency band" according to a preferred embodiment of the present invention.

Figure 23:
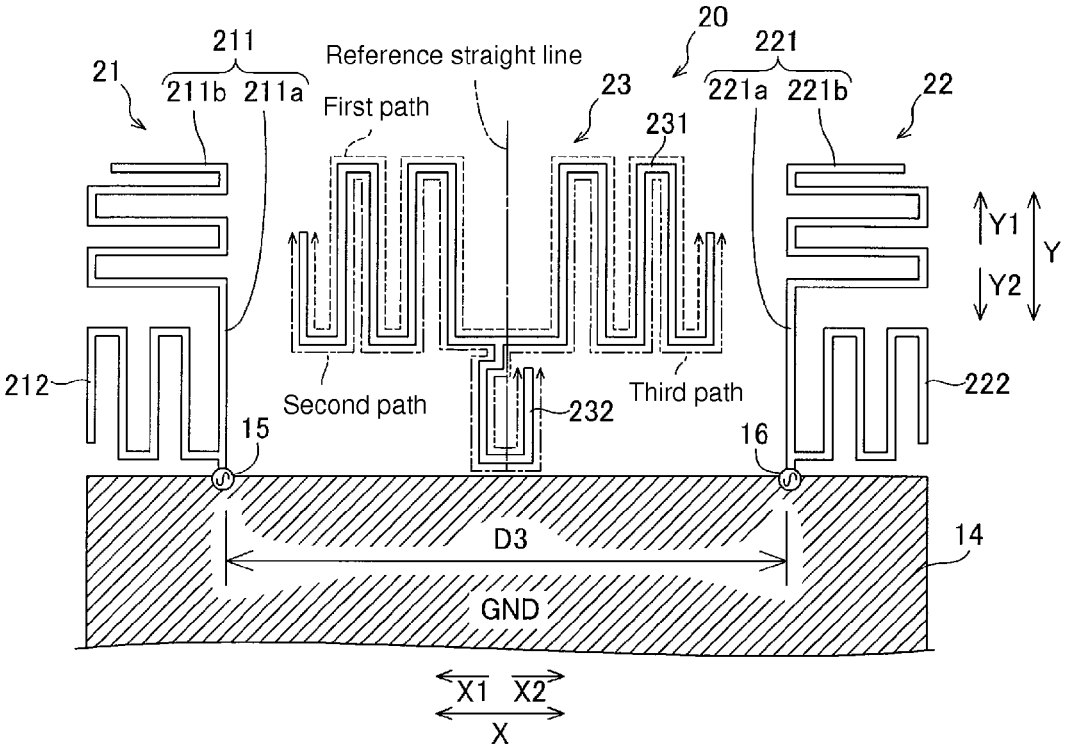
FIG. 23 is a plan view showing the multi-antenna device of the mobile phone according to the fourth preferred embodiment of the present invention.

As is shown in FIG. 23, the multi-antenna device 20 preferably includes a first antenna element 21, a second antenna element 22, the passive element 23 disposed between the two antenna elements 21 and 22, and the ground surface 14. The multi-antenna device 20 further preferably includes a first feeding point 15 arranged to supply high-frequency power to the first antenna element 21, and a second feeding point 16 arranged to supply high-frequency power to the second antenna element 22. Moreover, the first antenna element 21, the second antenna element 22, and the passive element 23 are preferably all provided on the front-side surface of a substrate, which is not illustrated.

The first antenna element 21 is disposed at the X1 direction side of the passive element 23, and the second antenna element 22 is disposed at the X2 direction side of the passive element 23. In addition, the first antenna element 21 and the second antenna element 22 are preferably provided in a substantially line symmetrical shape with respect to each other and to a reference straight line which is perpendicular or substantially perpendicular to the straight line connecting the first feeding point 15 and the second feeding point 16 and which passes through the midpoint between the first feeding point 15 and the second feeding point 16. Furthermore, the first antenna element 21 (second antenna element 22) preferably has a thin plate shape. Moreover, the first antenna element 21 (second antenna element 22) is preferably a monopole antenna. In concrete terms, the first antenna element 21 (second antenna element 22) includes a first frequency band corresponding unit 211 (221) having an electrical length equal or approximately equal to ¼ of the 1.5 GHz wavelength λ1 and a second frequency band corresponding unit 212 (222) having an electrical length equal or approximately equal to ¼ of the 2.0 GHz wavelength λ2, with the multi-antenna device 20 being compatible with both of these bands. The first frequency band corresponding unit 211 (221) and the second frequency band corresponding unit 212 (222) preferably both include one end portion open, and the other end portion grounded to the ground surface 14 via the first feeding point 15 (second feeding point 16). In addition, the first frequency band corresponding unit 211 (221) and the second frequency band corresponding unit 212 (222) are preferably provided integrally with each other as a single monolithic member.

The first frequency band corresponding unit 211 (221) preferably includes a power supply connection portion 211*a* (221*a*) connected to the first feeding point 15 (second feeding point 16) and a main unit portion 211*b* (221*b*) linked to the power supply connection portion 211*a* (221*a*). The power supply connection portion 211*a* (221*a*) of the first frequency band corresponding unit 211 (221) is arranged in a rectilinear shape so as to extend in the Y1 direction from the first feeding point 15 (second feeding point 16). That is, the power supply connection portion 211*a* of the first antenna element 21 and the power supply connection portion 221*a* of the second antenna element 22 are disposed in parallel or substantially in parallel to each other. The main unit portion 211*b* (221*b*) is linked to the end portion of the power supply connection portion 211*a* (221*a*) on the side (at the Y1 direction side) opposite from the side on which the first feeding point 15 (second feeding point 16) is provided. Furthermore, the main unit portion 211*b* (221*b*) is disposed on the side (at the Y1 direction side) of the second frequency band corresponding unit 212 (222) opposite from the side on which the first feeding point 15 (second feeding point 16) is disposed (at the Y2 direction side). Moreover, the main unit portion 211*b* (221*b*) is configured so as to extend in the Y1 direction while being folded at a plurality of positions in the X direction. That is, the main unit portion 211*b* (221*b*) is shaped so as to be bent at a plurality of positions. In addition, the inner end portion (the end portion on the side on which the passive element 23 is disposed) of the main unit portion 211*b* (221*b*) in the X direction is disposed so as to be flush with the inner end portion of the power supply connection portion 211*a* (221*a*). Furthermore, the configuration is such that the full length of the main unit portion 211*b* (221*b*) is longer than the full length of the power supply connection portion 211*a* (221*a*).

The second frequency band corresponding unit 212 (222) is preferably configured so as to extend to the outside (to the side opposite from the side on which the passive element 23 is disposed) while being folded at a plurality of positions in the Y direction. That is, the second frequency band corresponding unit 212 (222) is preferably shaped so as to be bent at a plurality of positions. Moreover, the second frequency band corresponding unit 212 (222) is disposed on the outside of the power supply connection portion 211*a* (221*a*) of the first frequency band corresponding unit 211 (221). In addition, the second frequency band corresponding unit 212 (222) is disposed so as to be adjacent to the main unit portion 211*b* (221*b*) of the first frequency band corresponding unit 211 (221) at the Y2 direction side of the main unit portion 211*b* (221*b*). Furthermore, the second frequency band corresponding unit 212 (222) is disposed in an area enclosed by the power supply connection portion 211*a* (221*a*) and main unit portion 211*b* (221*b*) of the first frequency band corresponding unit 211 (221). Moreover, the outer end portion of the second frequency band corresponding unit 212 (222) is disposed so as to be flush with the outer end portion of the main unit portion 211*b* (221*b*) of the first frequency band corresponding unit 211 (221).

The passive element 23 is disposed between the first antenna element 21 and the second antenna element 22 in an area between the straight line connecting the Y1 direction-side end portions of the first antenna element 21 and second antenna element 22 and the straight line connecting the Y2 direction-side end portions of the first antenna element 21 and second antenna element 22. That is, the passive element 23 is disposed within an area in which the first antenna element 21 and the second antenna element 22 face each other. In addition, the passive element 23 is preferably provided in an ungrounded state, such that the passive element 23 is not grounded to the ground surface 14. Furthermore, the passive element 23 is preferably configured so as to resonate at both the frequency corresponding to the 1.5 GHz band (frequency near 1.5 GHz) and the frequency corresponding to the 2.0 GHz band (frequency near 2.0 GHz). Moreover, the passive element 23 is shaped so as to be bent at a plurality of positions. In addition, the passive element 23 includes a main unit portion 231 and a branch portion 232 that branches from the main unit portion 231.

The main unit portion 231 is shaped so as to be bent at a plurality of positions. In concrete terms, the main unit portion 231 is preferably arranged so as to extend in the X direction (in the direction in which the first antenna element 21 and the second antenna element 22 face each other) while being folded at a plurality of positions in the Y direction. Furthermore, the main unit portion 231 is preferably disposed at a distance which allows coupling with both the first antenna element 21 and the second antenna element 22. Moreover, the main unit portion 231 is disposed between the respective main unit portions 211*b* and 221*b* of the first antenna element 21 and second antenna element 22 in an area corresponding to the main unit portions 211*b* and 221*b*. In addition, the end portion of the main unit portion 231 on the side of the first antenna element 21 (second antenna element 22) is arranged so as to extend in the Y direction and faces the first antenna element 21 (second antenna element 22). In concrete terms, the end portion of the main unit portion 231 on the side of the first antenna element 21 (second antenna element 22) is disposed so as to face the main unit portion 211*b* of the first antenna element 21 (main unit portion 221*b* of the second antenna element 22). Furthermore, the end portion of the main unit portion 231 on the side of the first antenna element 21 (second antenna element 22) is preferably disposed so as to also face the power supply connection portion 211*a* of the first antenna element 21 (power supply connection portion 221*a* of the second antenna element 22). Moreover, the main unit portion 231 preferably defines a first path which extends from the X1 direction-side end portion and reaches the X2 direction-side end portion. The first path preferably has an electrical length equal or approximately equal to ½ of the 1.5 GHz wavelength λ1 to which the first frequency band corresponding unit 211 (221) corresponds. Consequently, the passive element 23 resonates at the frequency corresponding to the 1.5 GHz band (frequency near 1.5 GHz). In addition, the main unit portion 231 is preferably provided in a line symmetrical shape with respect to the aforementioned reference straight line. Note that in the fourth preferred embodiment, coupling refers to the concept of electromagnetic coupling that includes both capacitive coupling and magnetic coupling.

The branch portion 232 of the passive element 23 preferably branches from a position which is or substantially is ½ of the full length of the main unit portion 231. Furthermore, the branch portion 232 is disposed at the Y2 direction side of the main unit portion 231. In concrete terms, the branch portion 232 is preferably disposed between the respective second frequency band corresponding units 212 and 222 of the first antenna element 21 and second antenna element 22 in an area corresponding to the second frequency band corresponding units 212 and 222. Moreover, the branch portion 232 is shaped so as to be bent at a plurality of positions. In addition, the branch portion 232 is preferably arranged in an asymmetrical shape with respect to the aforementioned reference straight line.

Furthermore, the branch portion 232 and the main unit portion 231 preferably define a second path which extends from the X1 direction-side end portion of the main unit portion 231 and reaches the tip end portion of the branch portion 232. Moreover, the branch portion 232 and the main unit portion 231 preferably defines a third path which extends from the X2 direction-side end portion of the main unit portion 231 and reaches the tip end portion of the branch portion 232. Specifically, the second path is defined by the branch portion 232 and a portion of the main unit portion 231 on the side of the first antenna element 21, while the third path is configured from the branch portion 232 and a portion of the main unit portion 231 on the side of the second antenna element 22. In addition, both the second path and the third path have an electrical length equal or approximately equal to ½ of the 2.0 GHz wavelength λ2 to which the second frequency band corresponding unit 212 (222) corresponds. Consequently, the passive element 23 resonates at the frequency corresponding to the 2.0 GHz band (frequency near 2.0 GHz).

Note that the remainder of the configuration of the fourth preferred embodiment is the preferably same or substantially the same as that of the aforementioned third preferred embodiment.

In the fourth preferred embodiment, as was described above, as a result of the single passive element 23 which preferably resonates at both the frequency corresponding to the 1.5 GHz band and the frequency corresponding to the 2.0 GHz band being provided between the first antenna element 21 and the second antenna element 22, the amount of interconnection between the antenna elements can be reduced in the same manner as in the aforementioned third preferred embodiment. As a result, it is possible to reduce the distance between the antenna elements and thus to miniaturize the multi-band compatible multi-antenna device 20. Specifically, with the configuration of the fourth preferred embodiment as well, in which the main unit portion 231 of the passive element 23 is arranged so as to extend in the X direction (in the direction in which the first antenna element 21 and the second antenna element 22 face each other) while being folded in the Y direction, it is possible to reduce the distance between the antenna elements and thus to miniaturize the multi-band compatible multi-antenna device 20 in the same manner as in the aforementioned third preferred embodiment. Note that the effect of being able to reduce the amount of interconnection between the antenna elements with the aforementioned configuration has been confirmed by simulation performed by the inventor of the present application which will be described later.

Note that the other advantageous effects of the fourth preferred embodiment are preferably the same as those of the aforementioned third preferred embodiment.

Next, the results of the simulation performed in order to confirm the advantageous effects of the fourth preferred embodiment will be described. With this simulation, the multi-band compatible multi-antenna device 20 corresponding to the fourth preferred embodiment shown in FIG. 23 and the multi-antenna device 110 according to the comparative example shown in FIG. 20 were compared.

With the multi-antenna device 20 corresponding to the fourth preferred embodiment, the first antenna element 21 and the second antenna element 22 were disposed such that the separation distance D3 for the feeding points was about 35.5 mm, for example. Note that the multi-antenna device 20 corresponding to the fourth preferred embodiment is compatible with both 1.5 GHz and 2.0 GHz. Furthermore, the remainder of the configuration of the multi-antenna device 20 corresponding to the fourth preferred embodiment is preferably the same as that of the multi-antenna device 10 corresponding to the third preferred embodiment.

Figure 24:
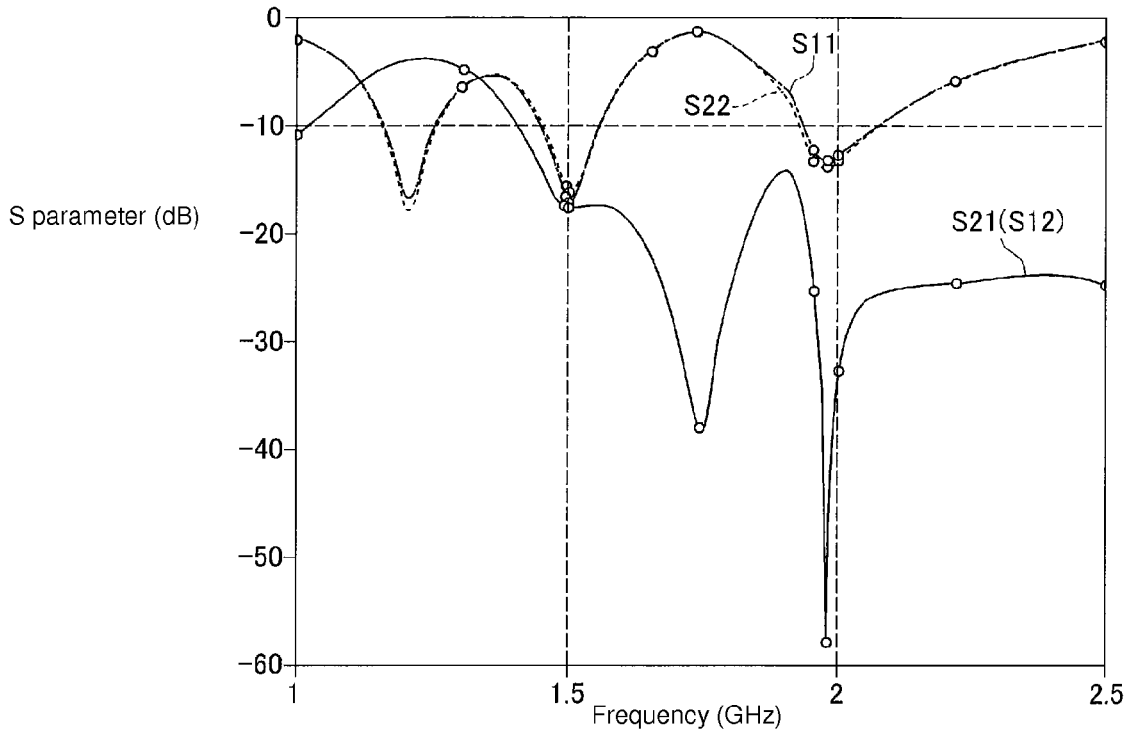
FIG. 24 is a diagram showing the S parameter characteristics with a simulation of the multi-antenna device corresponding to the fourth preferred embodiment of the present invention.

Next, while referring to FIGS. 21 and 24, a description will be given regarding the S parameter characteristics of the multi-antenna device 110 according to the comparative example and the multi-antenna device 20 corresponding to the fourth preferred embodiment.

First, with the multi-antenna device 110 according to the comparative example, at 1.5 GHz, S11 (S22) was approximately −13 dB, while S21 (S12) was approximately −9.5 dB as described above. Moreover, with the multi-antenna device 110 according to the comparative example, the resonance point near 2.0 GHz was 1.8 GHz, at which S11 (S22) was approximately −25 dB, while S21 (S12) was approximately −12 dB. In contrast, with the multi-antenna device 20 corresponding to the fourth preferred embodiment, at 1.5 GHz, S11 (S22) was approximately −17 dB, and S21 (S12) was approximately −18 dB as shown in FIG. 24. In addition, with the multi-antenna device 20 corresponding to the fourth preferred embodiment, the resonance point near 2.0 GHz was 1.95 GHz, at which S11 (S22) was approximately −13 dB, while S21 (S12) was approximately −58 dB. Note that the shift in the resonance point with the multi-antenna device 110 according to the comparative example and the multi-antenna device 20 corresponding to the fourth preferred embodiment is thought to occur due to the presence or absence of electromagnetic coupling between the passive element and the antenna element.

As a result, the value of S21 (S12) indicating the strength (size) of the interconnection between the two antenna elements is smaller at both 1.5 GHz and 2.0 GHz with the multi-antenna device 20 corresponding to the fourth preferred embodiment than with the multi-antenna device 110 according to the comparative example, so it was confirmed that the amount of interconnection between the antenna elements can be reduced by providing the ungrounded passive element 23.

Note that the preferred embodiments disclosed herein are shown as examples in all respects and should be considered to be non-restrictive. The scope of the present invention is not limited by the description of the preferred embodiments and includes all modifications with an equivalent meaning to the above described preferred embodiments of the present invention.

For example, in the third and fourth preferred embodiments, an example was described in which the multi-antenna device of the present invention is preferably applied to a mobile phone, but the present invention is not limited to this. For instance, the multi-antenna device according to various preferred embodiments of the present invention may also be applied to, for example, a PDA (Personal Digital Assistant), a notebook computer, or communication equipment other than a mobile phone such as a wireless router.

Furthermore, in the third and fourth preferred embodiments, multi-antenna devices for MIMO communication were shown as examples of a multi-antenna device, but the present invention is not limited to these. With the present invention, for example, it is also possible for it to be a multi-antenna device compatible with a system other than MIMO, such as, for example, a diversity system.

Moreover, in the third and fourth preferred embodiments, an example was shown in which both the first antenna element and the second antenna element are preferably provided on the front-side surface of a substrate (within the same plane), but the present invention is not limited to this. With various preferred embodiments of the present invention, the first antenna element and the second antenna element may also be provided on different surfaces from each other.

In addition, in the third and fourth preferred embodiments, an example was shown in which the main unit portions of the first frequency band corresponding units and the second frequency band corresponding units are preferably disposed so as to be respectively adjacent to each other in the Y direction, but the present invention is not limited to this. With various preferred embodiments of the present invention, the main unit portions of the first frequency band corresponding units and the second frequency band corresponding units may also be disposed so as to be respectively adjacent to each other in the X direction.

Furthermore, in the third and fourth preferred embodiments, an example was shown in which the multi-antenna device is preferably configured so as to be compatible with two different frequency bands: the 1.5 GHz band and the 2.0 GHz band, but the present invention is not limited to this. With various preferred embodiments of the present invention, the multi-antenna device may also be configured so as to be compatible with two frequency bands other than the 1.5 GHz band and the 2.0 GHz band. Moreover, with various preferred embodiments of the present invention, the multi-antenna device may also be configured so as to be compatible with three or more frequency bands.

Figure 25:
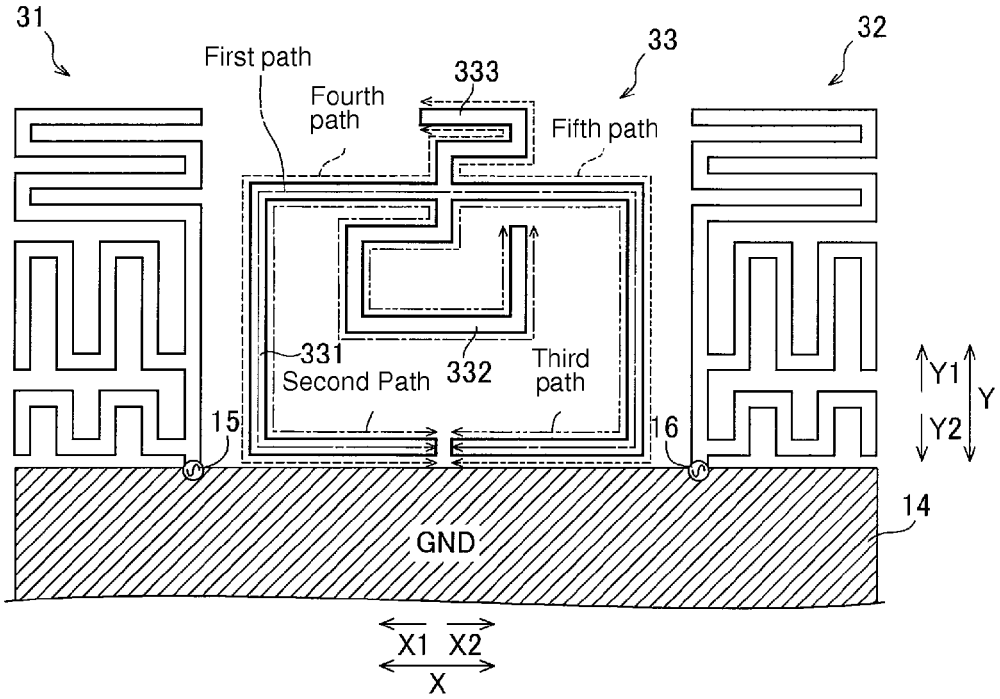
FIG. 25 is a plan view showing the multi-antenna device according to a first modified example of the third and fourth preferred embodiments of the present invention.

For example, in cases where the multi-antenna device according to various preferred embodiments of the present invention is configured so as to be compatible with three frequency bands: a first frequency band, a second frequency band, and a third frequency band, as is shown in FIG. 25, a passive element 33 which resonates at any of the frequencies among the frequency corresponding to the first frequency band, the frequency corresponding to the second frequency band, and the frequency corresponding to the third frequency band is provided between a first antenna element 31 and a second antenna element 32. In such cases, the passive element 33 is provided with a main unit portion 331, a first branch portion 332, and a second branch portion 333. In addition, a portion of the main unit portion 331 on the side of the first antenna element 31 (second antenna element 32) is preferably arranged so as to extend in the Y direction and also disposed so as to face the first antenna element 31 (second antenna element 32). Then, it is preferable that a first path having an electrical length equal or approximately equal to ½ of the wavelength corresponding to the first frequency band be configured from the main unit portion 331, that a second path (third path) having an electrical length equal or approximately equal to ½ of the wavelength corresponding to the second frequency band be configured from a portion of the main unit portion 331 and the first branch portion 332, and that a fourth path (fifth path) having an electrical length equal or approximately equal to ½ of the wavelength corresponding to the third frequency band be configured from a portion of the main unit portion 331 and the second branch portion 333. By adopting such a configuration, it is possible to obtain a multi-antenna device compatible with a triple band which can be miniaturized by reducing the distance between the antenna elements. Note that the first branch portion 332 and the second branch portion 333 are both examples of the "branch portion" according to a preferred embodiment of the present invention.

Figure 26:
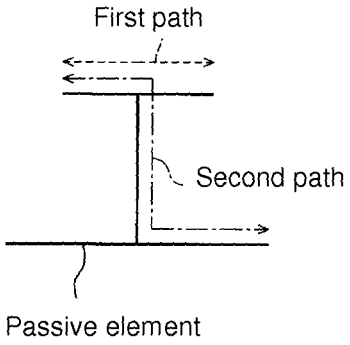
FIG. 26 is a plan view showing the passive element of the multi-antenna device according to a second modified example of the third and fourth preferred embodiments of the present invention.
Figure 27:
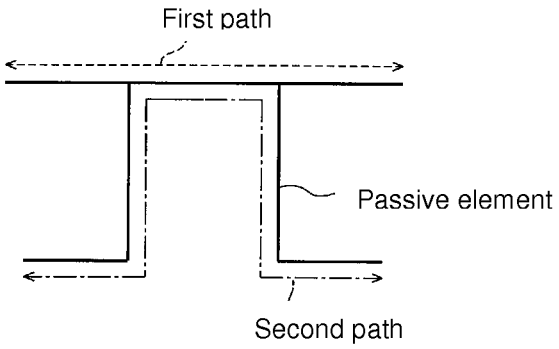
FIG. 27 is a plan view showing the passive element of the multi-antenna device according to a third modified example of the third and fourth preferred embodiments of the present invention.
Figure 28:
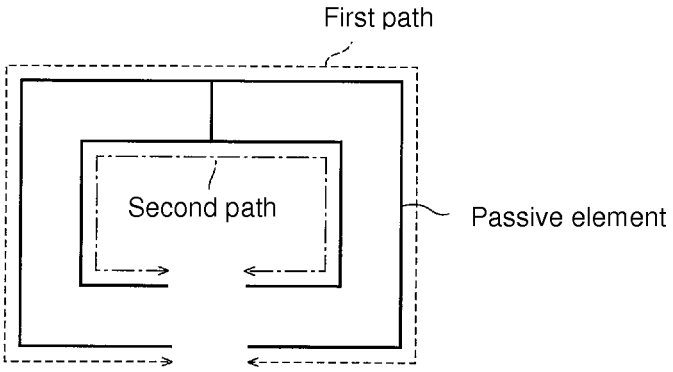
FIG. 28 is a plan view showing the passive element of the multi-antenna device according to a fourth modified example of the third and fourth preferred embodiments of the present invention.

Furthermore, with various preferred embodiments of the present invention, the passive element is not limited to the passive element of the shapes shown in the third and fourth preferred embodiments, and it is also possible to have a shape other than those of the passive elements shown in the third and fourth preferred embodiments as long as it is a passive element which resonates at both the frequency corresponding to the first frequency band and the frequency corresponding to the second frequency band as shown in FIGS. 26 to 28, for example. In this case, the passive element is configured such that the first path and the second path having mutually different electrical lengths are provided. Moreover, in the passive element of FIG. 28, a portion on the side of the first antenna element (second antenna element) is disposed so as to face the first antenna element (second antenna element). In addition, the passive elements of FIGS. 26 to 28 have at least a portion coupled to an antenna element.

Furthermore, in the third and fourth preferred embodiments, a first antenna element (second antenna element) preferably defined by a monopole antenna was shown as one example of the first antenna element (second antenna element), but the present invention is not limited to this. With various preferred embodiments of the present invention, a first antenna element (second antenna element) other than a monopole antenna, such as, for example, a dipole antenna, may also be used.

Figure 29:
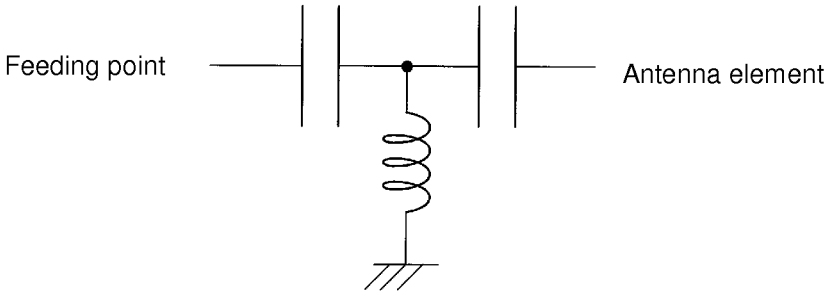
FIG. 29 is a schematic diagram of a T-type matching circuit used in a modified example of the third preferred embodiment of the present invention.
Figure 30:
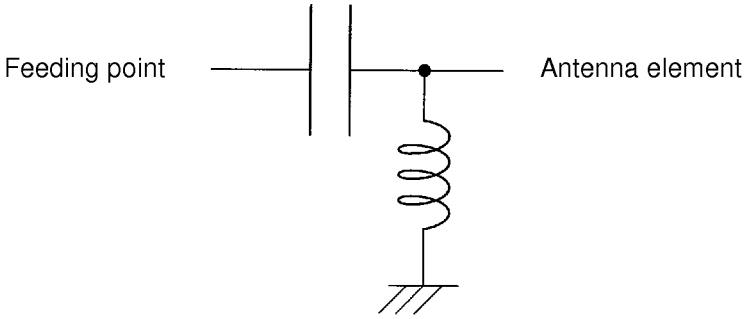
FIG. 30 is a schematic diagram of an L-type matching circuit used in a modified example of the third preferred embodiment of the present invention.

Moreover, in the third preferred embodiment, π-type matching circuits (π match) were shown as one example of the matching circuits of various preferred embodiments of the present invention, but the present invention is not limited to this. With various preferred embodiments of the present invention, for instance, in order to achieve impedance matching, it is also possible to provide T-type matching circuits (T match) (see FIG. 29) or to provide L-type matching circuits (L match) (see FIG. 30). In addition, each of the π-type matching circuits, T-type matching circuits, and L-type matching circuits may be provided by only either one of an inductor (i.e., a coil) and a capacitor or may also be defined by both an inductor and a capacitor.

Furthermore, in the fourth preferred embodiment, an example was shown in which the main unit portion of the passive element is disposed between the respective main unit portions of the first antenna element and second antenna element in an area corresponding to the main unit portions, and the branch portion is disposed between the respective second frequency band corresponding units of the first antenna element and second antenna element in an area corresponding to the second frequency band corresponding units, but the present invention is not limited to this. With various preferred embodiments of the present invention, it is also possible to dispose the branch portion between the respective main unit portions of the first antenna element and second antenna element in an area corresponding to the main unit portions and to dispose the main unit portion between the respective second frequency band corresponding units of the first antenna element and second antenna element in an area corresponding to the second frequency band corresponding units.

Moreover, in the third and fourth preferred embodiments, an example was shown in which the first antenna element, the second antenna element, and the passive element are all arranged in a bent shape, but the present invention is not limited to this. With various preferred embodiments of the present invention, the first antenna element, the second antenna element, and the passive element may also be arranged in a curved shape or may also be arranged in a combination of bent and curved shapes.

Figure 31:
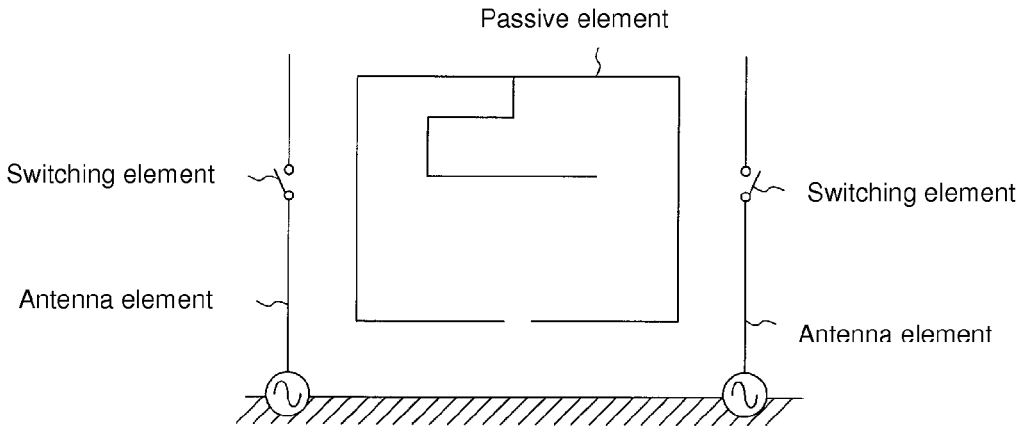
FIG. 31 is a plan view showing the multi-antenna device according to a fifth modified example of the third and fourth preferred embodiments of the present invention.
Figure 32:
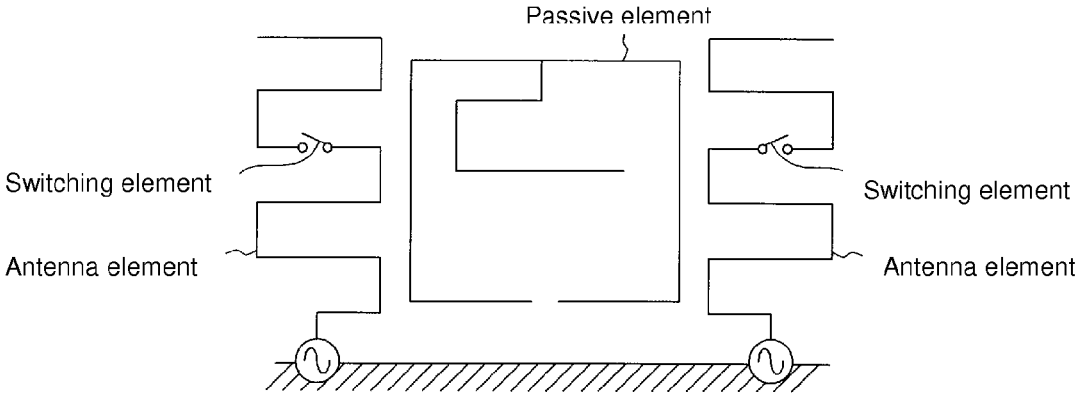
FIG. 32 is a plan view showing the multi-antenna device according to a sixth modified example of the third and fourth preferred embodiments of the present invention.

In addition, in the third and fourth preferred embodiments, an example was shown in which the first frequency band corresponding unit and second frequency band corresponding unit of each antenna element are preferably provided integrally with each other as a single monolithic member, but the present invention is not limited to this. With various preferred embodiments of the present invention, as is shown in FIGS. 31 and 32, a configuration is also possible in which the full length of each antenna element is preferably modified by providing a switching element in each antenna element, thus making the multi-antenna device compatible with the first frequency band and the second frequency band. Furthermore, in each of the passive elements of FIGS. 31 and 32, a portion on the side of one antenna element (the other antenna element) is preferably disposed so as to face this one antenna element (the other antenna element).

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A multi-band compatible antenna device comprising:

a first antenna element and a second antenna element, each of the first antenna element and the second antenna element including a first frequency band unit corresponding to a first frequency band and a second frequency band unit corresponding to a second frequency band; and a single passive element which is arranged between the first antenna element and the second antenna element, and the single passive element has a first path that resonates at a frequency corresponding to the first frequency band and a second path that resonates at a frequency corresponding to the second frequency band; wherein the first frequency band unit of each of the first and second antenna elements includes a first branch of the respective first and second antenna elements, and the second frequency band unit of each of the first and second antenna elements includes a second branch of the respective first and second antenna elements.

2. The multi-band compatible antenna device according to claim 1, wherein the passive element is arranged between the first antenna element and the second antenna element at a position in which electromagnetic coupling to both the first antenna element and the second antenna element occurs.

3. The multi-band compatible antenna device according to claim 1, wherein the passive element is ungrounded.

4. The multi-band compatible antenna device according to claim 3, wherein the passive element has the first path having an electrical length equal or substantially equal to ½ of the wavelength λ1 of the electric wave that is output corresponding to the first frequency band by the first antenna element and the second antenna element, and the second path having an electrical length equal or substantially equal to ½ of the wavelength λ2 of the electric wave that is output corresponding to the second frequency band by the first antenna element and the second antenna element.

5. The multi-band compatible antenna device according to claim 4, wherein the passive element includes a main unit portion and a branch portion which branches from the main unit portion;

the first path is configured from the main unit portion; and the second path is configured from a portion of the main unit portion and the branch portion.

6. The multi-band compatible antenna device according to claim 5, wherein the branch portion is arranged to branch from a position at or substantially at ½ of the full length of the main unit portion; and the passive element is arranged so as to define the first path which is defined from the main unit portion and which has an electrical length equal or substantially equal to ½ of the wavelength λ1, the second path which is defined by the branch portion and a portion of the main unit portion on the side of the first antenna element and which has an electrical length equal or substantially equal to ½ of the wavelength λ2, and a third path which is defined by the branch portion and a portion of the main unit portion on the side of the second antenna element and which has an electrical length equal or substantially equal to ½ of the wavelength λ2 that is substantially the same as the second path.

7. The multi-band compatible antenna device according to claim 6, wherein the first antenna element and the second antenna element are arranged in a substantially line symmetrical shape with respect to each other and to a reference straight line which is perpendicular or substantially perpendicular to the straight line connecting the respective feeding points of the first antenna element and the second antenna element having high-frequency power supplied thereto and which passes through a midpoint between the feeding points; and the main unit portion of the passive element is arranged in a substantially line symmetrical shape with respect to the reference straight line.

8. The multi-band compatible antenna device according to claim 7, wherein the branch portion is arranged to branch from a position at or substantially at ½ of the full length of the main unit portion arranged in a substantially line symmetrical shape with respect to the reference straight line and is provided in a bent or curved shape.

9. The multi-band compatible antenna device according to claim 1, wherein the first antenna element, the second antenna element, and the passive element are all bent or curved at a plurality of positions.

10. The multi-band compatible antenna device according to claim 1, wherein the passive element is arranged so as to span across a plurality of surfaces.

11. The multi-band compatible antenna device according to claim 1, wherein the first antenna element and the second antenna element both correspond to a third frequency band in addition to the first frequency band and the second frequency band; and the passive element is arranged so as to resonate at the frequency corresponding to the third frequency band and the frequency corresponding to the first frequency band and the frequency corresponding to the second frequency band.

12. The multi-band compatible antenna device according to claim 1, wherein the antenna device further comprises matching circuits which are respectively arranged on the side of the first antenna element and on the side of the second antenna element, between the antenna elements and the feeding points having high-frequency power supplied thereto, and which are arranged to achieve impedance matching at the frequency corresponding to the first frequency band and the frequency corresponding to the second frequency band of the high-frequency power.

13. The multi-band compatible antenna device according claim 1, wherein the first antenna element and the second antenna element each include a monopole antenna.

14. Communication equipment comprising:

a multi-band compatible multi-antenna device; wherein the multi-band compatible multi-antenna device includes:

a first antenna element and a second antenna element, each of the first antenna element and the second antenna element including a first frequency band unit corresponding to a first frequency band and a second frequency band unit corresponding to a second frequency band; and a single passive element which is arranged between the first antenna element and the second antenna element and the single passive element has a first path that resonates at a frequency corresponding to the first frequency band and a second path that resonates at a frequency corresponding to the second frequency band; wherein the first frequency band unit of each of the first and second antenna elements includes a first branch of the respective first and second antenna elements, and the second frequency band unit of each of the first and second antenna elements includes a second branch of the respective first and second antenna elements.

* * * * *